US008512872B2

(12) United States Patent
Cabot et al.

(10) Patent No.: US 8,512,872 B2
(45) Date of Patent: Aug. 20, 2013

(54) SEALED ANODIC COATINGS

(75) Inventors: Timothy P. Cabot, Cambridge, MA (US); John J. Tetrault, Cumberland, RI (US); Dong-Jin Sung, Wayland, MA (US)

(73) Assignee: Dupalectpa-CHN, LLC, Woonsocket, RI (US)

( * ) Notice: Subject to any disclaimer, the term of this patent is extended or adjusted under 35 U.S.C. 154(b) by 431 days.

(21) Appl. No.: 12/947,197

(22) Filed: Nov. 16, 2010

(65) Prior Publication Data

US 2011/0284383 A1 Nov. 24, 2011

Related U.S. Application Data

(63) Continuation-in-part of application No. 12/783,130, filed on May 19, 2010.

(51) Int. Cl.
*C25D 7/00* (2006.01)
*B32B 15/04* (2006.01)

(52) U.S. Cl.
USPC ..... 428/472.2; 428/469; 428/472.1; 205/50; 205/324; 205/333

(58) Field of Classification Search
None
See application file for complete search history.

(56) References Cited

U.S. PATENT DOCUMENTS 2,698,262 A 12/1954 Balmas
2,755,239 A 7/1956 Glauser et al.
2,767,134 A 10/1956 Hampel et al.
2,888,388 A 5/1959 Stiller
3,016,293 A 1/1962 Cybriwsky et al.
3,071,494 A 1/1963 Humphreys
3,098,018 A 7/1963 Kissin et al.
3,171,797 A 3/1965 Klingenmaier et al.
3,257,244 A 6/1966 Barkman
3,365,377 A 1/1968 Michelson
3,376,143 A 4/1968 Barkman
3,402,458 A 9/1968 Assff
3,440,150 A 4/1969 Kramer et al.
3,494,839 A 2/1970 Chambers et al.
3,616,298 A 10/1971 Fassell, Jr.
3,616,311 A 10/1971 Barkman et al.
3,647,649 A 3/1972 Treiber
3,652,429 A 3/1972 Deltombe
3,689,379 A 9/1972 Treiber
3,734,784 A 5/1973 Bereday et al.
3,749,596 A 7/1973 Yoshimura
3,791,940 A 2/1974 Alexander
3,822,156 A 7/1974 Wallace
3,838,023 A 9/1974 Friedemann et al.
3,849,264 A 11/1974 Weber et al.
3,897,287 A 7/1975 Meyer et al.
3,956,082 A 5/1976 Yoshimura et al.
3,959,035 A 5/1976 Sheehan (Continued)

*Primary Examiner* — David Sample
(74) *Attorney, Agent, or Firm* — Lando & Anastasi, LLP

(57) ABSTRACT

Metal and metal alloys with sealed anodic oxide coatings with at least partial crystallinity are disclosed. Associated articles are correspondingly disclosed. The sealed anodic coatings exhibit steam, superheated steam, alkaline and acidic resistance. The crystalline sealed anodic oxide coating can be prepared by impregnation of pores of a metal or metal substrate with metal precursor species, conversion of the metal precursor species into metal hydroxides, thermal treatment to dry out moisture and to promote phase transformation of the metal hydroxide product into metal oxides solids and bonding with metastable metal oxide substance in the pore structure of the metal or metal alloy substrate, and hydrothermal sealing, to create sealed anodic coating.

7 Claims, 17 Drawing Sheets

(56) References Cited

U.S. PATENT DOCUMENTS 3,964,982 A 6/1976 Kim
3,969,195 A 7/1976 Dotzer et al.
4,002,549 A 1/1977 Yanagida et al.
4,028,205 A 6/1977 Dorsey, Jr.
4,031,275 A 6/1977 Alexander
4,043,880 A 8/1977 Yanagida et al.
4,045,599 A 8/1977 Remaley et al.
4,046,304 A 9/1977 Tabata et al.
4,060,462 A 11/1977 Kampert
4,065,364 A 12/1977 Fromson
4,065,365 A 12/1977 Ibarguengoitia
4,066,816 A 1/1978 Sheasby et al.
4,084,014 A 4/1978 Fabregas
4,094,750 A 6/1978 Mackey
4,103,048 A 7/1978 Alexander
RE29,754 E 9/1978 Fromson
4,121,980 A 10/1978 Gohausen et al.
4,128,461 A 12/1978 Lerner et al.
4,131,518 A 12/1978 Fromson
4,137,047 A 1/1979 Kim
4,159,927 A 7/1979 Bernard et al.
4,189,360 A 2/1980 Woods et al.
4,225,399 A 9/1980 Tomita
4,270,991 A 6/1981 Woods
4,288,299 A 9/1981 Carter
4,352,721 A 10/1982 Park et al.
4,367,122 A 1/1983 Bednarz
4,370,361 A 1/1983 Gray
4,383,042 A 5/1983 Coggins et al.
4,426,252 A 1/1984 Kape
4,427,458 A 1/1984 Hasegawa et al.
4,437,945 A 3/1984 Sells et al.
4,439,287 A 3/1984 Birkle et al.
4,445,983 A 5/1984 Gohausen et al.
4,470,884 A 9/1984 Carr
4,481,083 A 11/1984 Ball et al.
4,483,750 A 11/1984 Powers et al.
4,549,910 A 10/1985 Barba
4,549,983 A 10/1985 Wiegers et al.
4,582,588 A 4/1986 Jensen et al.
4,650,552 A 3/1987 de Nora et al.
4,715,936 A 12/1987 Florio
4,737,246 A 4/1988 Powers et al.
4,786,336 A 11/1988 Schoener et al.
4,828,736 A 5/1989 Sandberg et al.
4,828,737 A 5/1989 Sandberg et al.
4,839,002 A 6/1989 Pernick et al.
4,865,699 A 9/1989 Fromson et al.
4,882,237 A * 11/1989 Koyama ..... 428/699
4,894,127 A 1/1990 Wong et al.
4,897,124 A 1/1990 Matsuo et al.
4,936,927 A 6/1990 Grunke et al.
4,939,001 A 7/1990 Brodalla et al.
5,002,838 A 3/1991 Yasue et al.
5,139,449 A * 8/1992 Akahori ..... 440/76
5,151,169 A 9/1992 Galyon et al.
5,257,731 A 11/1993 Nonoyama et al.
5,358,623 A 10/1994 Bibber
5,362,569 A 11/1994 Bauman
5,374,347 A 12/1994 Pearlstein et al.
5,411,607 A 5/1995 Bagaly et al.
5,439,747 A 8/1995 Sturdevant et al.
5,486,283 A 1/1996 Mnich
5,541,145 A 7/1996 Harris et al.
5,558,690 A 9/1996 Hnat et al.
5,624,716 A 4/1997 Shulman
RE35,576 E 7/1997 Buchheit, Jr. et al.
5,693,208 A 12/1997 Paulet
5,753,056 A 5/1998 Opalka et al.
5,773,377 A 6/1998 Harris et al.
5,775,892 A 7/1998 Miyasaka et al.
5,830,570 A 11/1998 Ohkawa et al.
5,851,373 A 12/1998 Kubota et al.
6,001,481 A 12/1999 Dearnaley et al.
6,013,142 A 1/2000 Hacias
6,120,618 A 9/2000 Opalka
6,149,790 A 11/2000 Oikawa et al.
6,271,163 B1 8/2001 Yushio et al.
6,337,136 B1 1/2002 Suzuki et al.
6,372,115 B1 4/2002 Miyasaka et al.
6,409,905 B1 6/2002 Melody et al.
6,444,304 B1 * 9/2002 Hisamoto et al. ..... 428/319.1
6,475,368 B2 11/2002 Harrington et al.
6,531,013 B2 3/2003 Nitowski
6,533,917 B1 3/2003 Nishino et al.
6,540,900 B1 4/2003 Kinard et al.
6,548,324 B2 4/2003 Kinard et al.
6,562,652 B2 5/2003 Persico et al.
6,620,306 B2 9/2003 Yoshimura et al.
6,669,897 B2 12/2003 Harenski et al.
6,672,917 B2 1/2004 Matsuda et al.
6,686,053 B2 * 2/2004 Wada et al. ..... 428/472.2
6,744,621 B2 6/2004 Lessner et al.
6,811,893 B2 11/2004 Wakayama et al.
6,866,945 B2 3/2005 Kuo et al.
6,869,701 B1 3/2005 Aita et al.
7,125,610 B2 10/2006 Kinard et al.
7,175,676 B1 2/2007 Stevens et al.
7,323,230 B2 * 1/2008 Doan et al. ..... 427/569
7,732,056 B2 * 6/2010 Bhatnagar et al. ..... 428/472.2
8,124,240 B2 * 2/2012 Ohmi et al. ..... 428/469
2001/0024720 A1 9/2001 Sweet et al.
2001/0049018 A1 12/2001 Dearnaley et al.
2001/0050231 A1 12/2001 Heimann et al.
2002/0003093 A1 1/2002 Dull et al.
2002/0004102 A1 1/2002 Park et al.
2002/0012804 A1 1/2002 Heimann et al.
2002/0054998 A1 5/2002 Heimann et al.
2002/0100694 A1 8/2002 Morin et al.
2002/0174940 A1 11/2002 Nitowski
2003/0178317 A1 9/2003 Heimann et al.
2003/0209290 A1 11/2003 Heimann et al.
2003/0234183 A1 12/2003 Corl, III et al.
2004/0033339 A1 2/2004 Fukutani et al.
2004/0035911 A1 2/2004 Duckus et al.
2004/0038070 A1 2/2004 Duckus et al.
2004/0040854 A1 * 3/2004 Naganuma ..... 205/109
2004/0254608 A1 12/2004 Huitema et al.
2005/0031894 A1 2/2005 Klos et al.
2005/0044989 A1 3/2005 Liao
2006/0052824 A1 3/2006 Ransick et al.
2006/0052825 A1 3/2006 Ransick et al.
2006/0110621 A1 5/2006 Brilmyer et al.
2006/0134453 A1 6/2006 Kuwabara et al.
2006/0192309 A1 8/2006 Kukutani et al.
2006/0219568 A1 10/2006 Hotta et al.
2007/0040204 A1 2/2007 Pulugurtha et al.
2007/0054421 A1 3/2007 Ueda et al.
2007/0148479 A1 6/2007 Ishikazi et al.
2007/0288845 A1 12/2007 Gentry et al.
2007/0292775 A1 12/2007 Hamada
2008/0032121 A1 2/2008 Lawlor
2008/0057293 A1 3/2008 Hatanaka et al.
2008/0070056 A1 3/2008 Hatanaka et al.
2008/0081173 A1 4/2008 Hatanaka et al.
2008/0152941 A1 6/2008 Hatanaka et al.
2008/0163960 A1 7/2008 Parson et al.
2008/0274375 A1 11/2008 Ng et al.
2009/0061352 A1 3/2009 Hauck et al.
2009/0081411 A1 3/2009 Hatanaka
2010/0003537 A1 1/2010 Akarsu et al.
2010/0032301 A1 2/2010 Hiratsuka et al.

* cited by examiner

SEALED ANODIC COATINGS

CROSS-REFERENCE TO RELATED APPLICATION

This application is a continuation-in-part application of and claims the benefit of priority under 35 U.S.C. §120 of copending U.S. patent application Ser. No. 12/783,130, titled MICROCRYSTALLINE ANODIC COATINGS AND RELATED METHODS THEREFOR, filed on May 19, 2010, which is incorporated herein by reference in its entirety for all purposes.

BACKGROUND OF INVENTION

1. Field of Invention

This invention relates to coatings on metals and related methods therefor and, in particular, to coatings such as anodized coatings on metal and metal alloys that exhibit resistance to steam, including superheated steam, and resistance to alkaline and acidic degradation.

2. Discussion of Related Art

Anodic coatings for aluminum and aluminum alloys, for example, are typically classified by type and class. Type I coatings are derived from chromic acid electrolyte and type IB coatings from low voltage processes in chromic acid electrolyte. Type IC coatings are typically produced by non-chromic acid anodizing. Type II coatings can be produced in a sulfuric acid electrolyte. Type III coatings, also referred to as hard anodic coatings, are also produced in a sulfuric acid electrolyte. Class 1 coatings are dye free coatings and class 2 coatings are dyed coatings.

Type II and Type III are typically characterized as having significant porosity by the nature of the cell formation and coatings can be left unsealed or can be sealed. Sealing of anodic coatings on metal surfaces can be classified based on the composition of the seal solution, based on the operating temperature, or based on the mechanism of the process.

All anodic oxide coatings, regardless of type, are characterized by having no x-ray diffraction contrast, that is, they are amorphous and exhibit no crystallinity whatsoever, whether or not they are sealed.

Traditional sealing processes can be considered to include hot (boiling) deionized water sealing, steam sealing, sodium or potassium dichromate sealing, sodium silicate sealing, nickel acetate sealing, nickel fluoride sealing, and new sealing processes, such as cobalt acetate sealing, trivalent chromium sulfate or acetate sealing, cerium acetate sealing, zirconium acetate sealing, triethanolamine-based sealing, lithium or magnesium salt-based sealing, potassium permanganate sealing, polymer-based sealing, and oxidizing corrosion inhibitor-based sealing such as those involving molybdate, vanadate, tungstate, and perborate agents.

Sealing processes based on temperature can involve high temperature sealing (above 95° C.) with steam, hot water, and dichromate; mid-temperature sealing (80° C.-95° C.) with silicate and divalent or trivalent metal acetates, triethanolamine-based techniques, and oxidizing corrosion inhibitor based techniques; low temperature sealing (70° C.-80° C.) with metal acetate, and ambient temperature sealing (25° C.-35° C.) with nickel fluoride.

Sealing processes can also be classified by sealing mechanism, as by hydrothermal sealing, which typically involves converting the hydrated aluminum oxide to hydrated boehmite (aluminum oxide hydroxide, AlO(OH)); physical or chemical impregnation and reacting the pores of the anodic layer with dichromate, silicate, nickel fluoride, and polymer compounds; electrochemical sealing which involves electrophoretic migration and deposition anionic species in the pores; and corrosion inhibition sealing which involves thermal motion and diffusion promoted adsorption of corrosion inhibitors into the pores. None of the reactions has been shown to produce crystallinity in the anodic oxide coating.

Sealing of type I, IB, IC, II, IIB and III coatings can be performed by immersion in aqueous dichromate solutions with a pH of 5-6 and a temperature of 90° C.-100° C. for 15 minutes, by immersion in boiling deionized water, or by immersion in a cobalt acetate solution or a nickel acetate solution. Sealing can also be performed by immersion in a sealing medium of hot aqueous nickel acetate or cobalt acetate with a pH of 5.5-5.8 or by immersion in boiling deionized water. Duplex sealing with hot aqueous solutions of nickel acetate and sodium dichromate can also be performed on type I, IB, IC, II, IIB, and III coatings. In accordance with MIL-A-8625, type III coatings for abrasion or resistance service are typically not sealed. Otherwise, type III coatings can be sealed by immersion in boiling deionized water, in a hot aqueous sodium dichromate solution, or in a hot aqueous solution of nickel acetate or cobalt acetate, and other sealing mechanisms.

Smutting can be encountered in sealing processes, typically during hydrothermal sealing procedures. Smutting can result from the conversion of the coating surface to boehmite. Smutting is typically associated with high operational temperature and pH, long immersion time, aged sealing solution containing too much dissolved solids and breakdown of components of additives, and shortage of anti-smutting agents and/or surface active agents. Anti-smutting agents can inhibit the formation of boehmite on the coating surface without adversely affecting the sealing process within the pores. Typical anti-smutting agents include, for example, hydroxycarboxylic acids, lignosulfonates, cycloaliphatic or aromatic polycarboxylic acids, naphthalene sulfonic acids, polyacrylic acids, phosphonates, sulphonated phenol, phosphonocarboxylic acids, polyphosphinocarboxylic acids, phosphonic acids, and triazine derivatives.

As illustrated in FIG. 1, anodic coatings 102 on some nonferrous metals, such as aluminum and aluminum alloys 104, can have porous structures with cells including pores 106 and walls of a metal oxide, and a barrier oxide layer 108. The porous structure can be susceptible to aggressive environments and water adsorption, which can result in degradation of the anodized layer.

Conventional hydrothermal sealing process is typically performed by immersion or exposure to hot water or steam at temperatures above 80° C., which was believed to react with the oxide ($Al_2O_3$) in anodic coatings to form boehmite-like reaction product crystals (AlO(OH)) according to the following reaction:

$$Al_2O_3(\text{anodic coating})+H_2O \rightarrow 2AlO(OH) \quad (1)$$

Because boehmite (3.44 g/cm$^3$) has a larger volume per unit mass than aluminum oxide (3.97 g/cm$^3$), and because two moles of boehmite can be formed from one mole of aluminum oxide, the pores are eventually at least partially reacted, change in size, and typically blocked and closed by the resultant expansion of the cell walls of the modified anodic coating during hydrothermal sealing. No actual crystals or crystallinity are formed; the coating remains amorphous. Hydrolysable salts and organic agents can be utilized to improve the sealing performance and efficiency, save energy, and minimize the formation of smut on the surface of anodic coatings. For example, nickel ions from nickel acetate can catalytically hydrate aluminum oxide to boehmite through the co-precipitation of nickel hydroxide ($Ni(OH)_2$) according to the following reaction:

$$Ni^{2+}+2OH^-\rightarrow Ni(OH)_2\downarrow \quad (2)$$

In dichromate sealing, aluminum oxydichromate ($AlOHCrO_4$) or aluminum oxychromate ($(AlO)_2CrO_4$) typically forms in the pores according to the following reactions:

$$Al_2O_3+2HCrO_4^-+H_2O\rightarrow 2AlOHCrO_4^-\downarrow+2OH^- \quad (pH<6.0) \quad (3)$$

$$Al_2O_3+HCrO_4^-\rightarrow (AlO)_2CrO_4^-+OH^-(pH>6.0) \quad (4)$$

In silicate sealing, silicate ions react with aluminum oxide to form aluminum silicate ($Al_2OSiO_4$) in the pores of an anodic coating according to the following reaction:

$$Al_2O_3+SiO_3^{2-}+H_2O\rightarrow Al_2OSiO_4^-\downarrow+2OH^- \quad (5)$$

The pores of an anodic coating are not completely reacted in either dichromate sealing or silicate sealing. Accordingly, poor results may be anticipated if an acid dissolution test or a dye stain test is used to evaluate the sealing quality. However, dichromate sealing or silicate sealing can enhance the corrosion resistance of anodic coatings on aluminum, which is ascribed to the role of adsorbed chromate or silicate ion in inhibiting the corrosion of aluminum.

Cold sealing processes typically involve nickel fluoride-based sealing techniques. Because cold sealing processes are typically performed at room temperature, reaction (1) does not normally occur in the pores of an anodic coating. With the catalytic effect of co-precipitation of nickel hydroxide and aluminum fluoride, aluminum oxide is transformed to aluminum hydroxide instead of boehmite at temperatures below 70° C., as expressed in the following reactions:

$$Ni^{2+}+2OH^-\rightarrow Ni(OH)_2^- \quad (2)$$

$$Al_2O_3+6F^-+3H_2O\rightarrow 2AlF_3^-+6OH^- \quad (6)$$

$$Al_2O_3+3H_2O\rightarrow 2Al(OH)_3\downarrow \quad (7)$$

As with dichromate and silicate sealing, cold nickel fluoride sealing can be considered an impregnation process that does not completely fill and close the pores, despite the approximate 150% increase in volume when $Al_2O_3$ (3.97 g/cm$^3$) is transformed to $Al(OH)_3$ (2.42 g/cm$^3$) in accordance with reaction (7). It is recognized that aluminum hydroxide is chemically less stable and more soluble in aqueous solutions than boehmite. The formed $Al(OH)_3$ tends to be less ordered rather than ordered in form and the sealed anodic article performs poorly when evaluated with acid dissolution or dye stain tests.

Consequently, the corrosion resistance of anodized articles post treated by cold sealing can be considered inferior to that treated with conventional hydrothermal sealing and other impregnation processes mentioned above.

SUMMARY OF THE INVENTION

One or more aspects of the invention can relate to a method of producing a sealed anodic coating on a metal substrate, the sealed anodic coating having cells with pores and walls comprising at least one of partially crystalline metal oxide and partially crystalline metal hydroxide.

One or more further aspects of the invention can be directed to a method of producing a sealed anodized aluminum substrate having cells with pores and walls at least partially comprising at least one of crystalline aluminum oxide and crystalline aluminum hydroxide.

Some aspects of the invention can be directed to a method of producing a sealed anodized aluminum substrate having structures of at least one of partially crystalline aluminum oxide and partially crystalline aluminum hydroxide from an anodized aluminum substrate having cells with pores and walls of at least one of amorphous aluminum oxide and amorphous aluminum hydroxide. The method can comprise introducing a metal cationic species into at least a portion of the pores, converting at least a portion of the metal cationic species into a metal hydroxide, converting at least a portion of the metal hydroxide into a metal oxide, and converting at least a portion of the walls of at least one of amorphous aluminum oxide and amorphous aluminum hydroxide into structures of at least one of partially crystalline aluminum oxide and partially crystalline aluminum hydroxide. In a variant of such aspects of the invention, the method can comprise introducing a metal cationic species into at least a portion of the pores; converting at least a portion of the metal cationic species into a metal hydroxide; converting at least a portion of the metal hydroxide into a metal oxide; and converting at least a portion of walls of the pores of at least one of amorphous aluminum oxide and amorphous aluminum hydroxide into at least one of partially crystalline aluminum oxide and partially crystalline aluminum hydroxide. In one or more embodiments related to such methods, converting at least a portion of walls of the pores can comprise immersing the aluminum substrate in an aqueous metal salt solution having a temperature in a range of from about 75° C. to about 95° C. to convert at least a portion of at least one of the amorphous oxide and amorphous hydroxide into at least one of partially crystalline aluminum oxide and partially crystalline aluminum hydroxide. The aqueous metal salt solution can comprise at least one of a metal acetate and a metal nitrate. In one or more other embodiments related to such methods, converting at least a portion of the metal hydroxide can comprise heating, for example, the aluminum substrate in an oxidizing atmosphere at a temperature in a range of from about 150° C. to about 300° C. for an oxidizing period of at least about 30 minutes. In one or more further embodiments related to such methods, converting at least a portion of the metal cationic species can comprise immersing the metal substrate in an alkaline solution having a pH of at least about 8 units. In one or more further embodiments related to such methods, introducing the metal cationic species into at least a portion of the pores can comprise immersing the anodized aluminum substrate in an aqueous metal solution comprising a metal fluoride and a surfactant. In one or more still further embodiments related to such methods, introducing the metal cationic species into at least a portion of the pores comprises exposing the anodized aluminum substrate to ultrasonic energy in an ultrasonic bath that is free of any of fluoride species and free of a surfactant.

One or more aspects of the invention can be directed to a method of producing a sealed anodized aluminum substrate. The method can comprise immersing the anodized aluminum substrate in a first aqueous metal salt solution; exposing the aluminum substrate to an alkaline solution having a pH in a range of from about 8 units to about 13 units and ultrasonic energy after immersing the anodized aluminum substrate in the first aqueous solution; thermally treating the anodized aluminum substrate in an oxidizing atmosphere at a drying temperature of at least about 150° C. after immersing the anodized aluminum substrate in the alkaline solution; and immersing the anodized aluminum substrate in a second aqueous metal solution having a temperature in a range of from about 75° C. to about 95° C. after thermally treating the anodized aluminum substrate. In accordance with one or more aspects of the invention, the first aqueous metal salt solution can comprise a fluoride of at least one of nickel, iron, zinc, copper, magnesium, titanium, zirconium, aluminum, and silver. In accordance with one or more aspects of the invention, the first aqueous metal salt solution can have a pH of less than about 7 units and a temperature in a range of from about 15° C. to about 35° C. In accordance with one or more aspects of the invention, the first aqueous metal salt solution can comprise less than about 100 ppm of a surfactant and, in some cases, the first aqueous metal salt solution can comprise about 0.5 wt % to about 8.0 wt % of a metal cationic species. In accordance with one or more aspects of the invention, exposing the aluminum substrate can comprise immersing the anodized aluminum substrate in an alkaline solution comprising an alkali metal hydroxide, such as sodium hydroxide and potassium hydroxide (NaOH and KOH), and a surfactant for a period in a range of from about 1 minute to about 5 minutes. In some cases, the alkaline solution can have a temperature in a range of from about 20° C. to about 60° C. In accordance with one or more aspects of the invention, exposing the anodized aluminum substrate can comprise directing ultrasonic energy to the substrate, typically in an ultrasonic bath, for a period in a range of from about 10 minutes to about 25 minutes. In accordance with one or more further aspects of the invention, thermally treating the anodized aluminum substrate can comprise heating the anodized aluminum substrate in an oven at a temperature in a range of from about 150° C. to about 300° C., typically for a period of from about 30 minutes to about two hours. In some cases, the second aqueous metal solution can have a pH in a range of from about 5.0 units to about 6.0 units and, in still further cases, the solution can comprise at least one of a metal acetate and a metal nitrate in a concentration of from about 4.5 wt % to about 6.5 wt %.

One or more aspects of the invention can be directed to an aluminum article comprising a sealed anodized coating of at least about 0.05 mm, having a Taber abrasion loss of less than about 109 mg as determined in accordance with ASTM 4060, after immersion in a sodium hydroxide solution of at least about 0.04 wt % for about 11 days at a temperature in a range of from about 15° C. to about 25° C.

One or more aspects of the invention can be directed to an aluminum article comprising a dyed sealed anodized coating of at least about 0.05 mm having a fading property of less than a $\Delta L^*$ of about 1.5, a $\Delta a^*$ of about 2.0, and $\Delta b^*$ of about 2.5 values, in accordance with a CIE (Commission Internationale d'Eclairage) 1976 L*, a*, b color scale, as performed in accordance with ASTM E 308, after exposure, for at least 5 cycles, to an ultrasonic cleaning process with a solution having a pH of 12, and to autoclaving at a temperature of about 275° F. In some cases, the ultrasonic cleaning is performed for at least about 45 minutes and, in still further cases, autoclaving is performed for at least about 45 minutes.

One or more aspects of the invention can be directed to an aluminum article comprising a sealed anodized metal coating of at least about 0.05 mm that is partially crystalline and having an X-ray diffraction (XRD) pattern as illustrated in FIG. 7. In some particular cases, the diffraction pattern exhibits peaks at about 18°, 37°, 44°, and 62°.

One or more aspects of the invention can be directed to a sealed anodized metal comprising a metallic substrate comprising a first metal; an anodic region, such as an anodic oxide region, contiguous with at least a portion of the metallic substrate. The anodic oxide region typically has a plurality of cells comprising an amorphous first metal oxide. Each of the cells can have a pore with a pore filler in at least a portion thereof. The pore filler can comprise at least one of a crystalline transition metal oxide, a crystalline precious metal oxide, a metalloid oxide, an alkali earth metal oxide, and an alkali metal oxide. The sealed anodized metal can further comprise a seal region adjacent to at least a portion of the anodic region. The seal region can comprise at least one of a crystalline first metal oxide, a crystalline precious metal oxide, a crystalline alkali metal oxide, a crystalline first metal hydroxide, a crystalline precious metal hydroxide, and a crystalline alkali metal hydroxide. In one or more embodiments of the invention, the precious metal can be one of silver, ruthenium, palladium, iridium, platinum, gold, and alloys or combinations thereof. In some embodiments of the invention, the first metal is aluminum or an alloy thereof. In other embodiments of the invention, the pore filler can comprise one or more of crystalline nickel oxide, tin oxide, cobalt oxide, magnesium oxide, silicon oxide, and sodium oxide. In still other embodiments of the invention, the anodic region can comprise columnar cells of aluminum oxide and pore fillers of crystalline nickel hydroxide. The seal region can comprise crystalline aluminum hydroxide. The seal region can, in some cases, comprise aluminum hydroxide that has a level of crystallinity that increases with a depth of the seal region. In yet further embodiments of the invention, the sealed anodized metal can further comprise an interfacial region positioned between the anodic region and the seal region, the interfacial region comprising at least one of crystalline transition metal hydroxide, crystalline alkali metal hydroxide, and crystalline precious metal hydroxide.

One or more aspects of the invention can be directed to metallic utensils having a bulk metallic portion comprising a first metal; and a sealed anodized coating on at least a portion of the bulk metallic portion, wherein the sealed anodic coating has a first region adjacent the bulk metallic portion, a second region, and an interfacial region between and contiguous with the first region and the second region. The first region typically has a plurality of cell structures comprising a first metal oxide, wherein each of the cell structures has a pore that at least partially contains a filler comprising at least one of a crystalline transition metal oxide, a crystalline precious metal oxide, a metalloid oxide, an alkali earth metal oxide, and an alkali metal oxide. The second region can comprise at least one of a crystalline first metal oxide, a crystalline precious metal oxide, a crystalline alkali metal oxide, a crystalline first metal hydroxide, a crystalline precious metal hydroxide, and a crystalline alkali metal hydroxide. The interfacial region can comprise at least one of a crystalline transition metal hydroxide, a crystalline precious metal hydroxide, and a crystalline alkali metal hydroxide. The first transition metal can be aluminum or an aluminum alloy. The first metal oxide can be amorphous aluminum oxide or amorphous aluminum alloy oxide. The filler can comprise crystalline nickel hydroxide. The interfacial region can comprise at least one of crystalline aluminum hydroxide and crystalline nickel hydroxide. The first region can comprise a plurality of columnar cell structures comprising aluminum oxide, with pores at least partially containing nickel hydroxide. The metallic utensil can be a medical device, a component of a medical device, such as a handle of a medical tool, a case for a medical device, a container utilized in a medical treatment facility, or an orthopedic device. The metallic utensil can be a component of a marine vessel, such as propellers, propeller shafts, winches, tensioners, blocks, eyes, rings, travelers, vangs, shackles, and jacks. The metallic utensil can be a consumer article or a component thereof, such as cookware, serving utensils, handles thereof, equipment housings, or enclosures. The metallic utensil can be an automotive component such as automotive trim. Further, the metallic utensil can be utilized in aerospace systems. The metallic utensil can also be one that is utilized in industrial environments, such as a canister or as a component of a housing, vent, duct, or as a component or pair of hydraulic systems.

BRIEF DESCRIPTION OF THE DRAWINGS

The accompanying drawings are not intended to be drawn to scale. In the drawings, each identical or nearly identical component or step that is illustrated in various figures is represented by a like numeral. For purposes of clarity, not every component or step may be labeled in every drawing. In the drawings.

DETAILED DESCRIPTION

Figure 1:
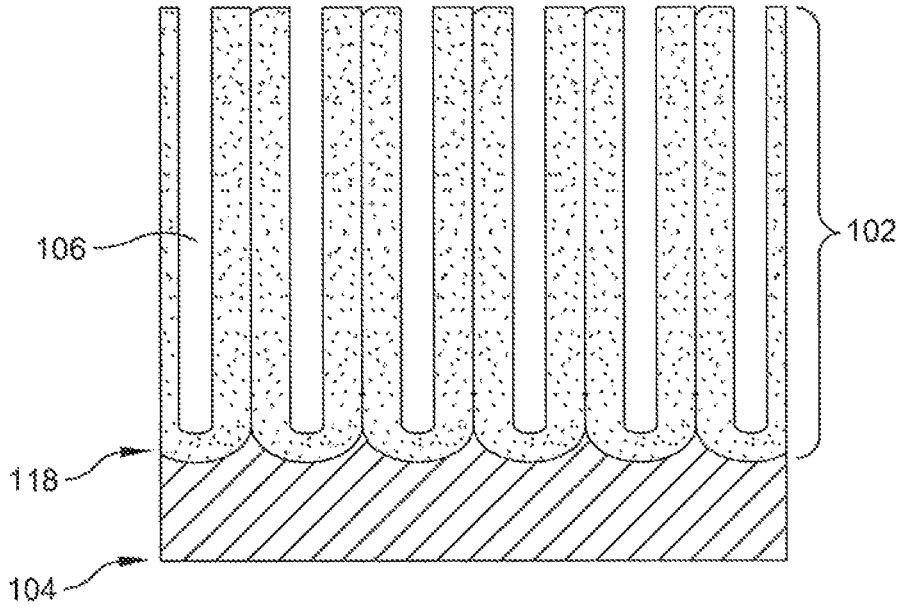
FIG. 1 is a schematic illustration showing an anodic coating for conversion or sealing thereof in accordance with one or more aspects of the present invention.
Figure 2:
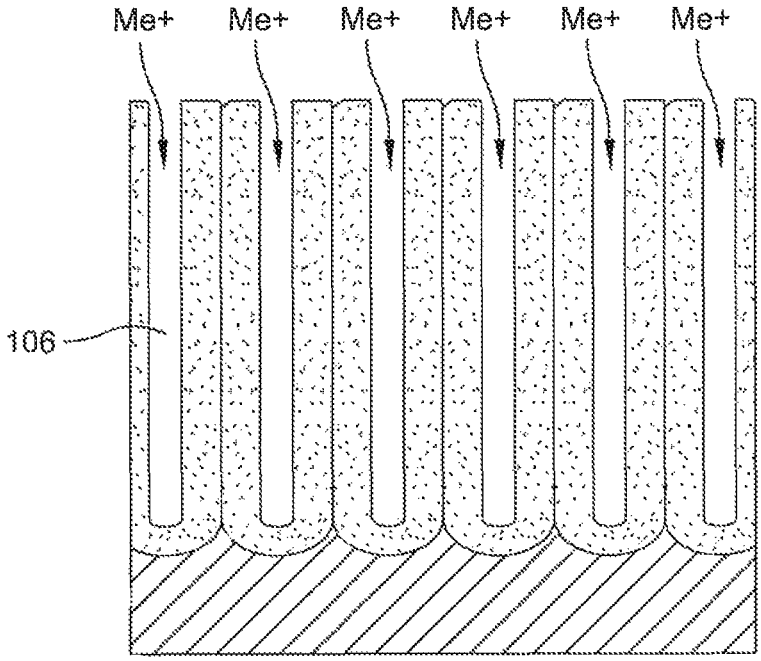
FIG. 2 is a schematic illustration showing introduction of metal precursor species into an anodic coating for conversion or sealing thereof in accordance with one or more aspects of the present invention.
Figure 3:
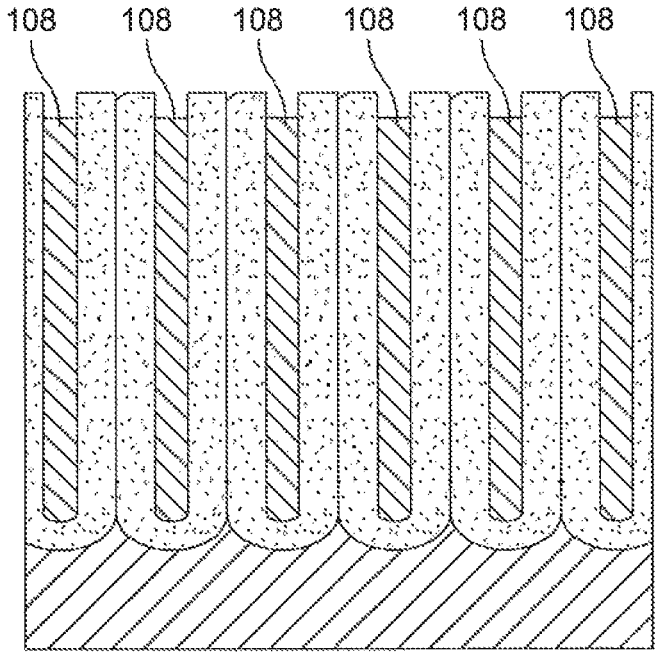
FIG. 3 is a schematic illustration showing conversion of the metal precursor species into an intermediate compound in an anodic coating for conversion or sealing thereof in accordance with one or more aspects of the present invention.

One or more aspects of the present invention can be directed to treatments that provide anodic coatings on metal substrates with desirable physical and chemical properties. One or more aspects of the invention can be directed to articles having at least partially crystalline anodic coatings thereon. Further aspects of the invention can be directed to techniques of producing a metal substrate having structures comprising at least one of partially crystalline metal oxide and partially crystalline metal hydroxide. Still further aspects of the invention can be directed to techniques of producing metal substrates having structures comprising at least one of at least partially crystalline metal oxide and at least partially crystalline metal hydroxide. Some aspects of the invention can be directed to fabricating anodized aluminum articles having features comprising at least one of crystalline aluminum oxide and crystalline aluminum hydroxide from aluminum articles having anodized coatings with cells defined by pores and walls of any of amorphous aluminum oxide and aluminum hydroxide. The procedures of the invention can involve introducing at least one metal cationic species into at least a portion of the pores, converting at least a portion of the metal cationic species into a metal hydroxide, converting at least a portion of the metal hydroxide into a metal oxide, and converting at least a portion of the cells of any of amorphous aluminum oxide and amorphous aluminum hydroxide to fabricate the anodized aluminum articles having at least partially crystalline features of at least one of at least partially crystalline aluminum oxide and at least partially crystalline aluminum hydroxide. One or more aspects of the invention can relate to techniques of producing an anodized aluminum substrate having structures that are preferably comprised of at least one of crystalline aluminum oxide and crystalline aluminum hydroxide, more preferably, at least one of partially crystalline aluminum oxide and partially crystalline aluminum hydroxide. One or more further aspects of the invention can involve promoting crystallinity of an anodic layer on a substrate.

One or more still further aspects of the invention can be directed to techniques of producing an anodized aluminum substrate.

The at least partially crystalline anodic coated articles pertinent to some aspects of the invention can be utilized in a variety of applications such as but not limited to tools including consumer hardware, trade equipment; equipment and machinery parts including those for semiconductor, oil and mineral extraction, and other industrial processes; medical devices and equipment including general medical and orthopedic equipment such as containers, trays, modules, handles, fixturing devices, carts; automotive components including exterior trim, engine and transmission parts, such as pistons, rings, valves; naval and marine components such as propellers, outdrives, cleats, winches, locks, masts, rigging, and other wetted components; electronic housing; aerospace parts and equipment; military parts and equipment including gun parts, night vision systems, electronic equipment, transportation equipment; household and commercial appliances such as dishwashers, driers, clothes washers, sinks; construction equipment and hardware such as bathroom and kitchen hardware; and cooking apparatus utensils, and equipment such as cookware, tableware for domestic and commercial use.

Some aspects of the invention can be directed to sealing of substrates that can at least partially fill the pores of cells, such as pores 106, by, for example, impregnation or filling with a barrier material that provides at least partial protection of the underlying material of the substrate from degradation of a metal as exemplarily illustrated in FIGS. 2-5.

Pores 106 can at least be partially impregnated or filled by introducing one or more compounds that is at least partially resistant to acidic attack or alkaline attack under various conditions. In accordance with one or more embodiments of the invention, the one or more compounds can be introduced into pores 106 by immersion of the metal substrate in a bath containing one or more precursor compounds under conditions that are non-reactive to the substrate metal or substrate metal oxide. Thus, in some cases, for example, one or more aspects of the invention can involve introducing one or more metal cationic species into at least a portion of the spaces or voids of a metal substrate, such as pores 106. In accordance with some embodiments of the invention, the metal substrate, such as an anodized aluminum substrate or an anodized aluminum alloy substrate, can be immersed in a first aqueous metal salt solution, preferably at ambient conditions. One or more embodiments of the invention can involve introducing one or more metal cationic species into at least a portion of the pores by, for example, immersing the metal substrate in an aqueous metal solution. The metal species or base metal salt in solution can at least partially impregnate at least a portion of the anodic oxide pores by diffusion phenomena as exemplarily illustrated in FIG. 2. Non-limiting examples of the metal that can be utilized as a precursor compound include nickel, iron, zinc, copper, magnesium, titanium, zirconium, aluminum, and silver. The bath or aqueous metal solution can have a pH of less than about 7 units and a temperature in a range of from about 15° C. to about 35° C. In accordance with one or more aspects of the invention, the first aqueous metal salt solution can comprise less than about 100 ppm of a surfactant and, in some cases, the bath or first aqueous metal salt solution can comprise, consist of, or consists essentially of about 0.5 to about 8.0 wt % of metal cationic species.

In accordance with some advantageous conditions, the aqueous metal solution can further comprise at least one surfactant. In some further advantageous configurations, the aqueous metal solution can be a bath containing a fluoride species. Thus, in some cases, the aqueous metal solution can comprise a fluoride of at least one of nickel, iron, zinc, copper, magnesium, titanium, zirconium, aluminum, and silver, with or without a surfactant. In some of such embodiments, at least a portion of the aluminum oxide of walls of pores 106 can react with the fluoride anionic species to form aluminum fluoride, typically at least a portion of the inside surfaces of the pores (not shown). In a variant thereof, the aqueous metal solution can consist essentially of a fluoride of at least one of nickel, iron, zinc, copper, magnesium, titanium, zirconium, aluminum, and silver, with at least one surfactant. In another variant thereof, the aqueous metal solution can consist essentially of a fluoride of at least one of nickel, iron, zinc, copper, magnesium, titanium, zirconium, aluminum, and silver, without a surfactant.

In one or more further variants in accordance with one or more such aspects of the invention, introducing the metal cationic species into at least a portion of the pores can comprise exposing the metal or metal alloy substrate to ultrasonic energy in an ultrasonic bath that is free of fluoride and/or free of a surfactant.

Some further aspects of the invention can involve converting at least a portion of the precursor compound, such as the metal cationic species, into a stable metal compound. For example, at least a portion of the metal cationic species can be converted or reacted to form a metal hydroxide. In some cases, the metal precursor can be induced to form a precipitate 108 and preferably fill, at least partially, pores 106, as exemplarily illustrated in FIG. 3, with, for example, the metal hydroxide. Converting at least a portion of the metal cationic species can comprise immersing, at least partially, the anodized metal or metal alloy substrate in an alkaline solution having a pH of at least about 8 units. For example, formation or conversion into the metal hydroxide can involve exposing the anodized aluminum substrate to an alkaline solution having a pH in a range of from about 8 units to about 13 units. In a variant of the process, the anodized metal or metal alloy, or at least a portion thereof, can be exposed to ultrasonic energy, after immersion in the first aqueous solution. In accordance with one or more aspects of the invention, exposing the anodized metal or metal alloy substrate can comprise immersing the anodized metal or metal alloy substrate in an alkaline solution comprising an alkali metal hydroxide or an alkali earth hydroxide and one or more surfactants for a period sufficient to convert at least a portion of the metal cationic species into a metal hydroxide. For example, conversion can involve immersion of the anodized metal substrate for a period in a range of from about 1 minute to about 5 minutes. The alkaline solution can consist essentially of an alkali metal hydroxide and a surfactant but in other cases, the alkaline solution can consist essentially of an alkali earth hydroxide and in yet other cases, the alkaline solution can consist essentially of a mixture of an alkali metal hydroxide and an alkaline earth hydroxide. The alkaline solution preferably has a temperature in a range of from about 20° C. to about 60° C.

In alternative or complementary cases in accordance with one or more further aspects of the invention, exposing the anodized metal or metal alloy substrate can comprise directing ultrasonic energy to the anodized metal or metal alloy substrate, typically in an ultrasonic bath, for a period sufficient to convert at least a portion, typically a predefined portion of the metal cationic species into a metal hydroxide. For example, the ultrasonic energy can be directed to an anodized aluminum substrate by immersion of the anodized aluminum substrate for a period in a range of from about 10 minutes to about 25 minutes.

Figure 4:
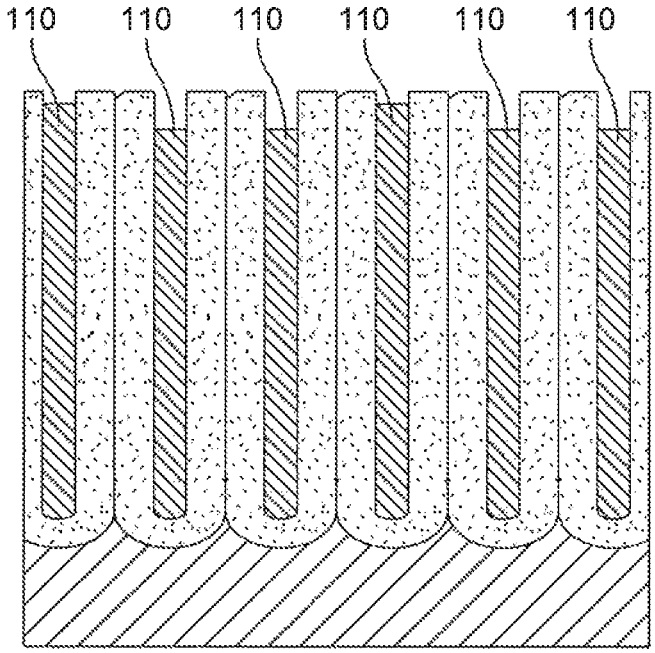
FIG. 4 is a schematic illustration showing conversion of the intermediate compound into metastable species in an anodic coating for conversion or sealing thereof in accordance with one or more aspects of the present invention.

One or more aspects of the invention can involve a thermal treatment that involves converting at least a portion of the metal hydroxide into a metal oxide. As illustrated in FIG. 4, at least a portion of the precipitated metal hydroxide 108 can be converted into a metastable metal oxide 110 in a portion of a metal or metal alloy substrate, such as at least some of the pores of the substrate. It is believed that at least a portion of the oxidation product is bonded to the metal oxides of the metal or metal alloy substrate, mechanically, chemically, or both. Conversion of at least a portion of the metal hydroxide precipitate 108 can comprise exposing the anodized metal or metal alloy substrate to conditions that thermodynamically favor at least partial oxidation, and in some cases, dehydration or drying, of the hydroxide precipitate. Conversion and bonding can be effected by heating the anodized metal substrate in an oxidizing atmosphere at a thermodynamic conversion temperature for a predetermined oxidizing period that provides a sufficient conversion yield. Depending on the conversion temperature, metal hydroxide oxidation to the metastable oxide can be performed in the oxidizing atmosphere in less than two hours. For example, conversion can be effected by heating in an oven at a temperature of at least about 150° C., typically in a range of from about 150° C. to about 300° C. for a period of at least about 30 minutes.

Figure 5:
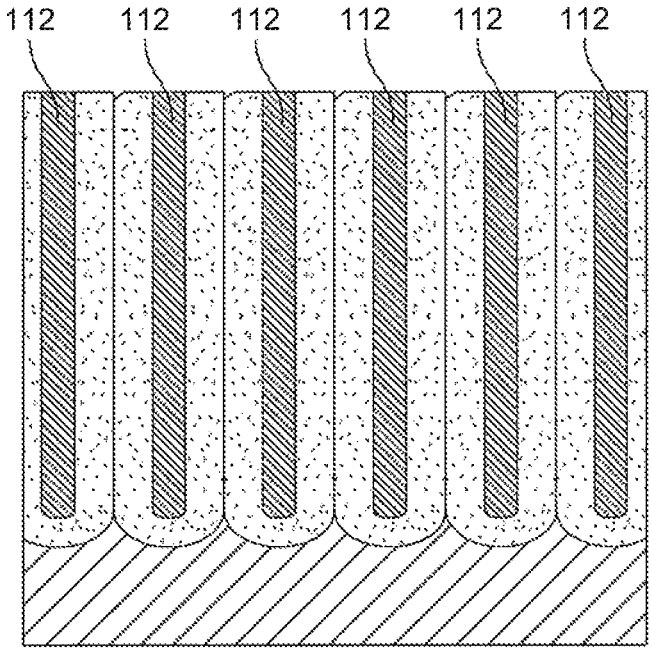
FIG. 5 is a schematic illustration showing conversion of the metastable species into a crystalline sealed anodized coating in accordance with one or more aspects of the present invention.

One or more further aspects of the invention can involve converting at least a portion of the structure of the pores, e.g., walls thereof, from an amorphous phase into structures that can at least partially comprise at least one of partially crystalline metal oxide and partially crystalline metal hydroxide 112, as exemplarily illustrated in FIG. 5. Conversion can also involve, in some cases, promoting crystallinity of at least a portion of the walls of the pores. Converting at least a portion of the structures can comprise immersing at least a portion of an anodized metal or metal alloy substrate in a second aqueous metal salt solution in conditions that favor conversion into partially crystalline metal oxide or partially crystalline metal hydroxide phase. For example, conversion to promote crystallinity can involve immersion of an anodized aluminum or anodized aluminum alloy substrate in a second aqueous metal solution at a temperature in a range of from about 75° C. to about 95° C. to convert at least one of the amorphous aluminum oxide and/or amorphous aluminum hydroxide thereof into at least one of partially crystalline metal oxide and partially crystalline metal hydroxide, typically into at least one of partially crystalline metal oxide and partially crystalline metal hydroxide. The second aqueous metal solution preferably has a pH in a range of from about 5 units to about 6 units and, in some cases, the second aqueous solution can comprise at least one of a metal acetate and a metal nitrate. In some cases, the second aqueous solution can consist essentially of a metal acetate or consist essentially of a metal nitrate. In still other cases, the second aqueous solution can consist essentially of a metal acetate and a metal nitrate. The concentration of the metal acetate and/or metal nitrate can be from about 4.5 wt % to about 6.5 wt %. Thus in some cases, promoting crystallinity can involve partial hydration to form boehmite-like crystals, with associated expansion, to close, at least partially, all or at least a substantial portion of the pores, to form partially crystalline structures.

Non-limiting examples of a surfactant that can be utilized in the various embodiments of the invention include non-ionic surfactants such as but not limited to hydrophilic polyethylene oxide, e.g., polyethylene glycol p-(1,1,3,3-tetramethylbutyl)-phenyl ether, which is commercially available as TRITON™ X-100 surfactant, from The Dow Chemical Company, Midland, Mich.

Figure 6:
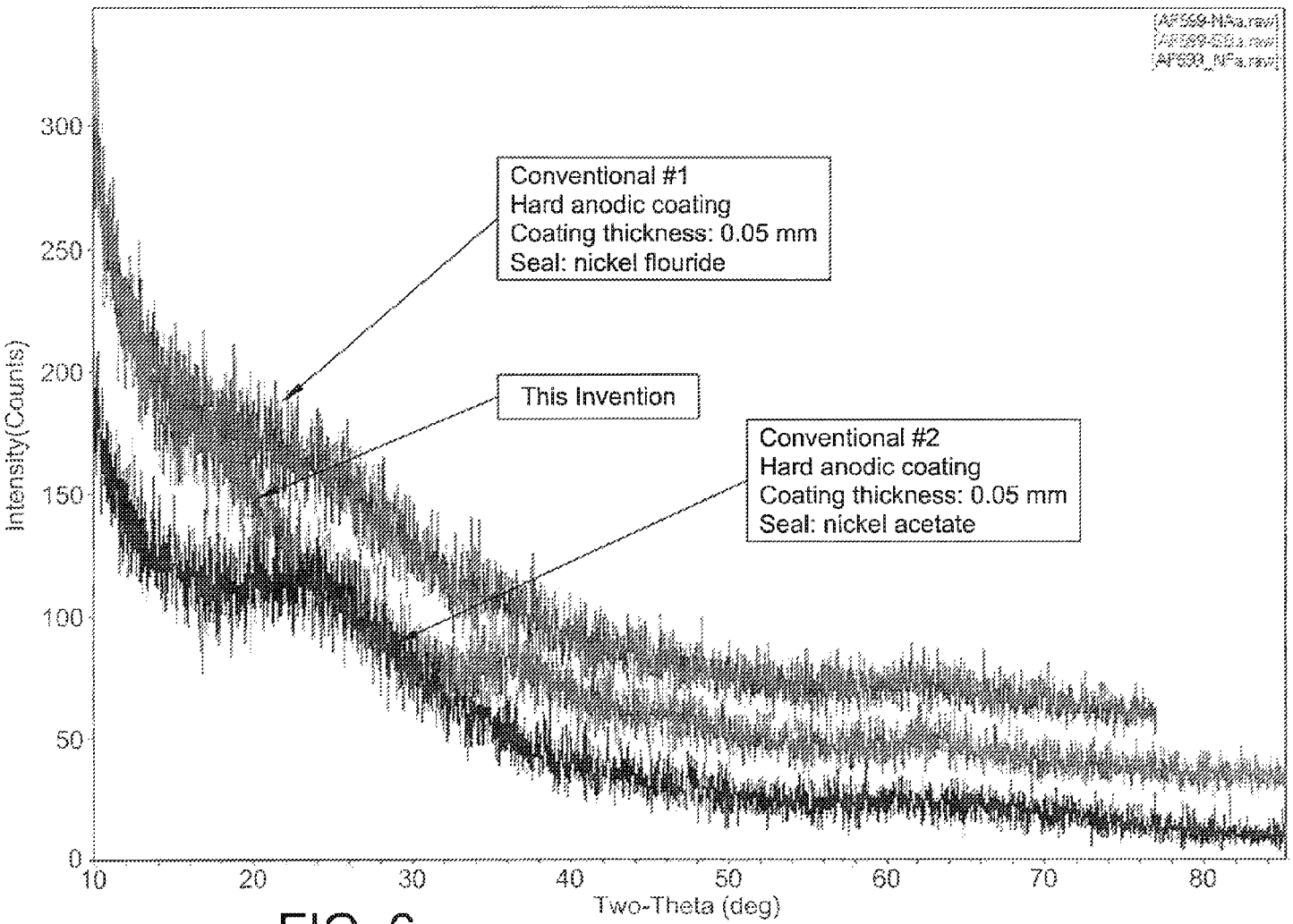
FIG. 6 is a copy of X-ray diffraction patterns of a crystalline sealed anodized coating on an aluminum substrate in accordance with one or more embodiments of the present invention, and of conventional amorphous anodic oxide coatings on aluminum substrates.
Figure 7:
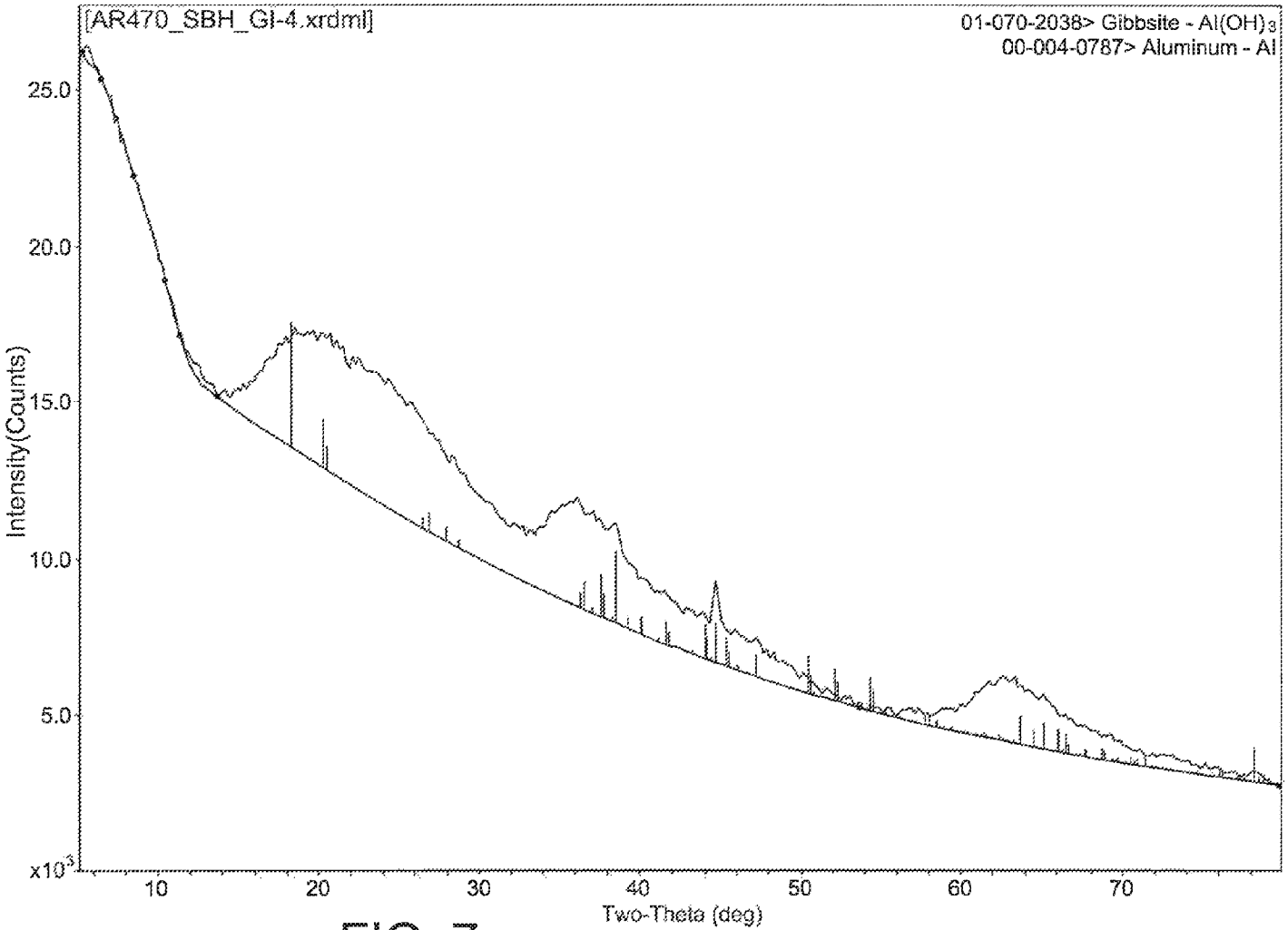
FIG. 7 is a copy of an X-ray diffraction pattern of a crystalline sealed anodized coating on an aluminum substrate in accordance with one or more embodiments of the present invention.

In embodiments of the invention involving sealing an anodized aluminum or anodized aluminum alloy substrate, the resultant sealed anodic coating thereof can be analytically characterized to have X-ray diffraction patterns or spectra as illustrated in FIGS. 6 and 7. The spectra presented at FIGS. 6 and 7 show two different XRD incident angles fixed at 1 and 4, respectively. In the spectra, the partially crystalline anodic coating, designated as "This Invention" in FIG. 6, exhibit partial crystalline character compared to the prior art amorphous, non-crystalline anodic coatings, designated as "Conventional #1" and "Conventional #2." In particular, partially crystalline aluminum hydroxide can be noted by the peaks at about 18°, 37°, 44°, and 62°.

Figure 12A:
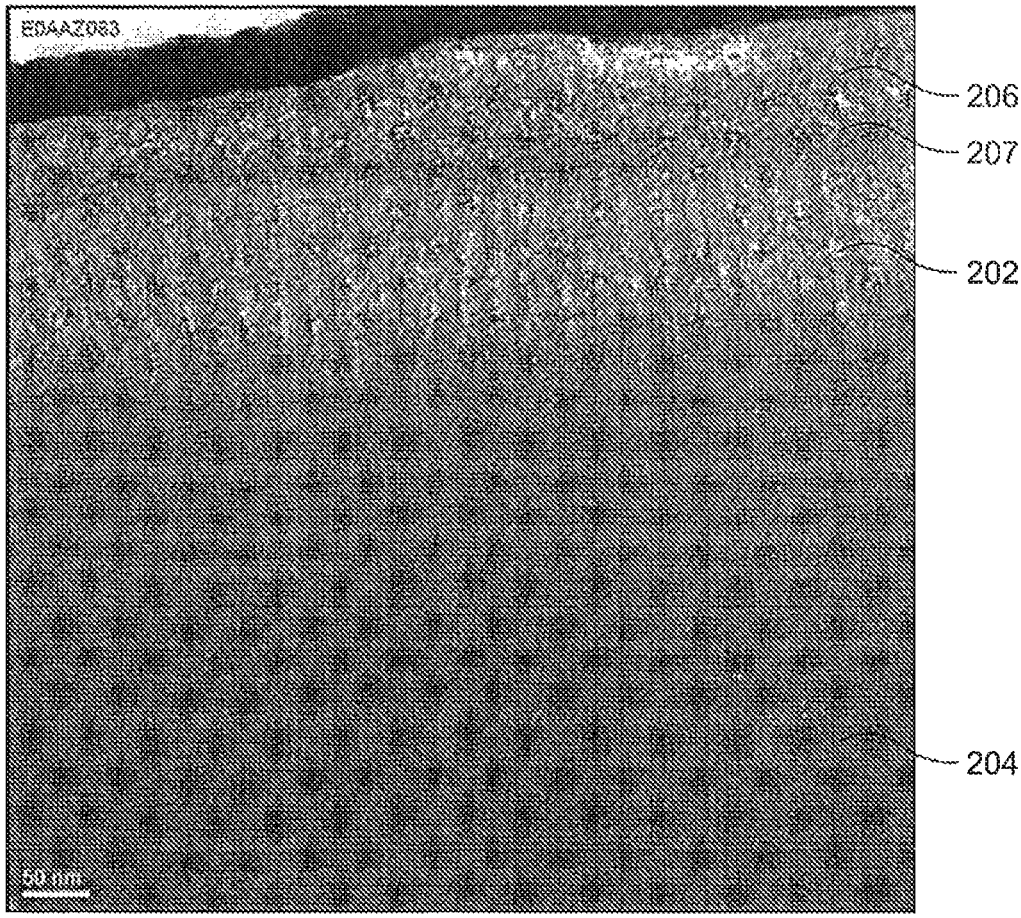
FIGS. 12A and 12B are copies of transmission electron microscope (TEM) photomicrographs of a portion of a sealed anodized aluminum in accordance with one or more embodiments of the invention.
Figure 12B:
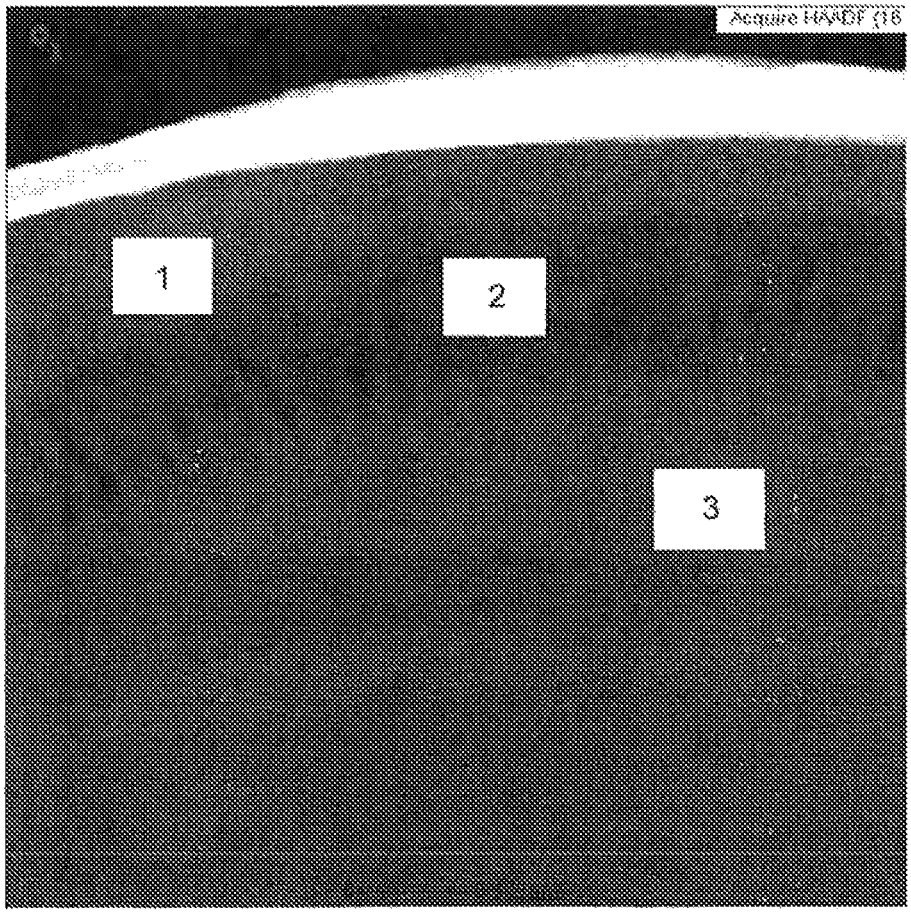
Figure 13A:
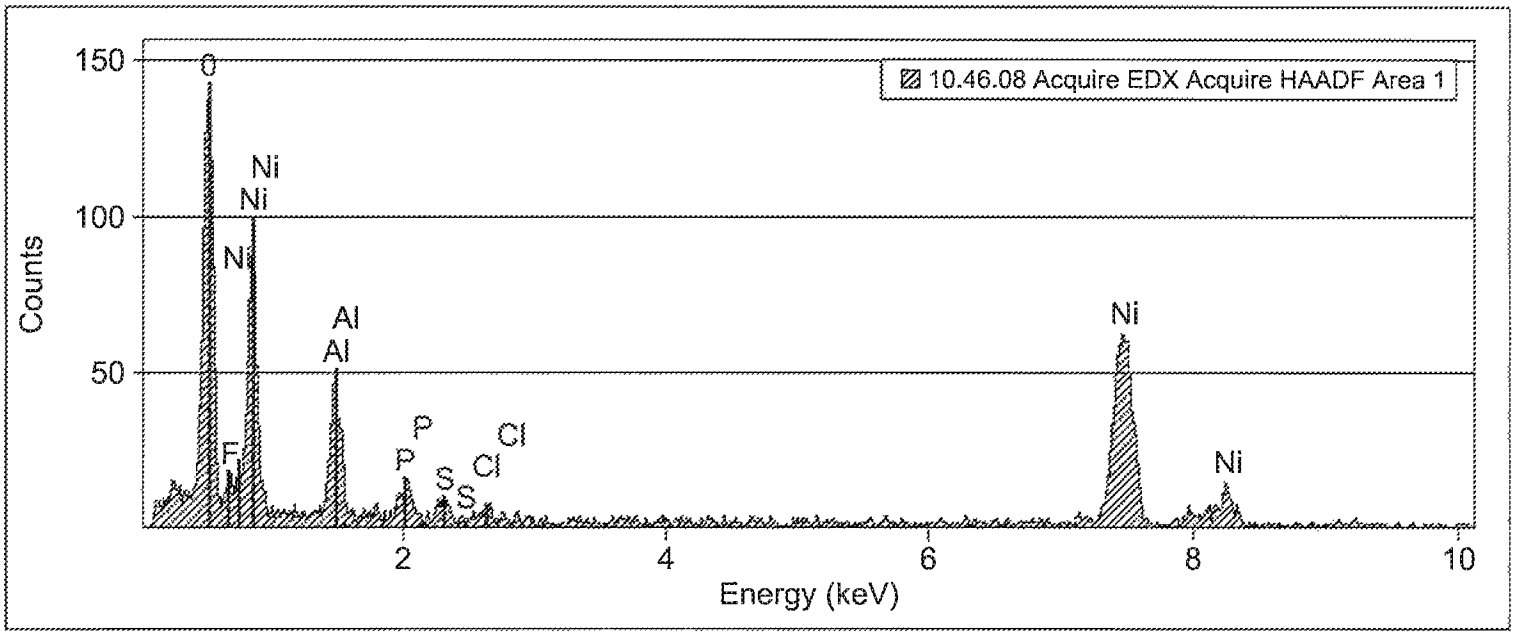
FIGS. 13A-13C are graphs showing the energy-dispersive X-ray spectra at various depths of the sealed anodized aluminum of FIG. 12B, with FIG. 13A showing the spectrum at about the position indicated by the region labeled "1", FIG. 13B showing the spectrum at about the position indicated by the region labeled "2", and FIG. 13C showing the spectrum at about the position indicated by the region labeled "3".
Figure 13B:
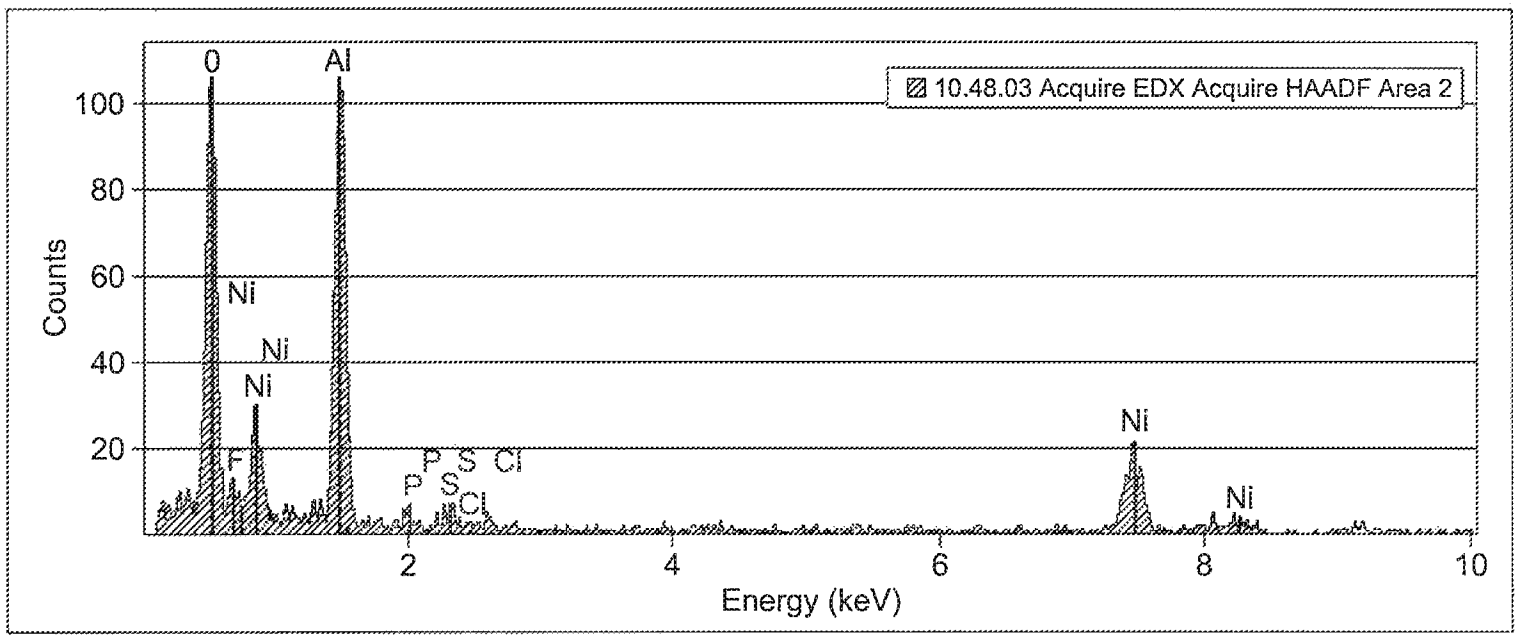
Figure 13C:
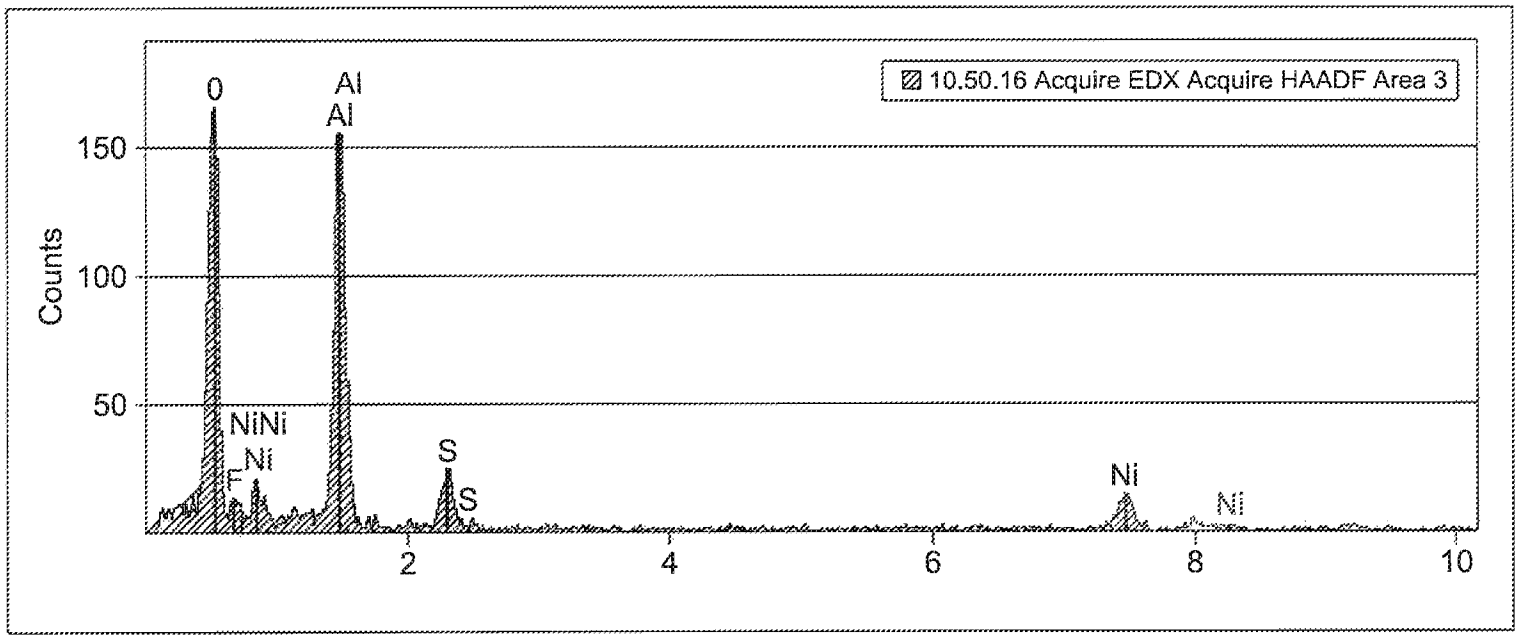

FIG. 12A is copy of a photograph of a sealed anodized metal substrate of the invention. The sealed anodized metal comprises a metallic substrate 204 comprised of a first metal, such as aluminum or aluminum alloy; an anodic region 202 contiguous with at least a portion of the metallic substrate. Anodic region 202 typically has a plurality of cells comprising an amorphous first metal oxide. Each of the plurality of cells typically has a pore with a pore filler in at least a portion thereof. The pore filler can comprise at least one of a crystalline transition metal oxide, a crystalline precious metal oxide, a metalloid oxide, an alkali earth metal oxide, and an alkali metal oxide. Anodic region 202 can comprise columnar cells of aluminum oxide and pore fillers of crystalline nickel hydroxide. The seal region can comprise crystalline aluminum hydroxide. The pore filler can comprise, consist essentially of, or consist of one of crystalline nickel oxide, tin oxide, cobalt oxide, magnesium oxide, silicon oxide, and sodium oxide.

The precious metal can be one of or combinations of silver, ruthenium, palladium, iridium, platinum, gold, and alloys thereof.

The sealed anodized metal can further comprise a seal region 206 adjacent to at least a portion of anodic region 202. Seal region 206 can comprise at least one of a crystalline first metal oxide, a crystalline precious metal oxide, a crystalline alkali metal oxide, a crystalline first metal hydroxide, a crystalline precious metal hydroxide, and a crystalline alkali metal hydroxide. In other cases, seal region 206 can consist essentially of, or consist of, any one of a crystalline first metal oxide, a crystalline precious metal oxide, a crystalline alkali metal oxide, a crystalline first metal hydroxide, a crystalline precious metal hydroxide, and a crystalline alkali metal hydroxide. The seal region can comprise a metal hydroxide, such as aluminum hydroxide, that has a level of crystallinity that increases with a depth of the seal region.

In yet further embodiments of the invention, the sealed anodized metal can further comprise an interfacial region 207 positioned between anodic region 202 and seal region 206. Interfacial region 207 can comprise at least one of crystalline transition metal hydroxide, crystalline alkali metal hydroxide, and crystalline precious metal hydroxide. In some cases, interfacial region 207 can consist essentially of, or consist of, any one of crystalline transition metal hydroxide, crystalline alkali metal hydroxide, and crystalline precious metal hydroxide.

One or more aspects of the invention can be directed to a sealed anodized aluminum article comprising a partially crystalline coating of at least about 0.05 mm having a Taber abrasion loss of less than about 109 mg as determined in accordance with ASTM 4060 after immersion in a sodium hydroxide solution at least about 0.04 wt % for 11 days at a temperature in a range of from about 15° C. to about 25° C. Further aspects of the invention can be directed to a sealed anodized aluminum article comprising a dyed anodized coating of at least about 0.05 mm having a fading that of less than a $\Delta L^*$ of about 1.5, a $\Delta a^*$ of about 2.0, and $\Delta b^*$ of about 2.5 values in accordance with a CIE (Commission Internationale d'Eclairage) 1976 L*, a*, b color scale as performed in accordance with ASTM E 308, after exposure, for at least 5 cycles, to ultrasonic cleaning with a solution having a pH of 12 and to autoclaving at 135° C. In such aspects, the article can provide fading resistance, after ultrasonic cleaning thereof for at least about 45 minutes and, in still further cases, after autoclaving is performed for at least about 45 minutes.

One or more further aspects of the invention can be directed to an aluminum article comprising an anodized partially crystalline coating, typically of at least about 0.05 mm. The anodized coating of at least about 0.05 mm can exhibit a Taber abrasion loss of less than about 109 mg as determined in accordance with ASTM 4060 after immersion in a sodium hydroxide solution at least about 0.04 wt % for 11 days at a temperature in a range of from about 15° C. to about 25° C.

As used herein, the term "partially crystalline" refers to anodic coatings that exhibit less than complete crystalline character. Partially crystalline metal hydroxide or partially crystalline metal oxides typically exhibit a repeating pattern that can be from the crystalline oxide, crystalline hydroxide, or both. Further, some aspects of the invention can be relevant to anodic coatings with partial polycrystalline character from polycrystalline metal oxides, polycrystalline metal hydroxides, or both.

EXAMPLES

The function and advantages of these and other embodiments of the invention can be further understood from the examples below, which illustrate the benefits and/or advantages of the one or more systems and techniques of the invention but do not exemplify the full scope of the invention.

In the examples, the anodic aluminum samples were prepared in accordance with the SANFORD QUANTUM® process. The aluminum samples were anodized in a solution of 250 gram/liter $H_2SO_4$ which was held at about 15° C.-21° C. A voltage of 14 VDC-18 VDC was applied. The samples were immersed in ambient nickel acetate solution for 20 minutes in an ultrasonic bath, followed by treatment in a 0.4 vol % NaOH solution having a pH of about 13 units, for about five minutes. The samples were then heat treated at about 250° C. for about one hour and finally immersed into a nickel acetate solution at about 90° C. for about 40 minutes.

Conventionally anodized aluminum samples were prepared by conventional type III hard anodizing process. The samples were anodized in a solution of 225 gram/Liter $H_2SO_4$ which was held at about −2° C.-0° C. A voltage of from 18 VDC to 33 VDC was applied. Samples were then sealed either using ambient nickel fluoride at about 25° C. for about 10 minutes or nickel acetate solution at 90° C. for 20 minutes.

Double sealed anodized aluminum samples were prepared by the SANFORD QUANTUM® process to provide a coating thickness of about 0.05 mm. Samples were anodized in a solution of 250 gram/liter $H_2SO_4$ which was held at about 15° C.-21° C. A voltage of about 14 VDC-18 VDC was applied. Samples were immersed in ambient nickel fluoride solution for 10 minutes and followed by nickel acetate solution at about 90° C. for about 20 minutes.

Example 1

This example illustrates the resistance of conventionally anodized aluminum substrate panels prepared according to the SANFORD QUANTUM® process to high pH conditions.

Several 4 inch×4 inch samples of various aluminum alloy panel were anodized using the SANFORD QUANTUM® process with varying coating thickness. Table 1 shows run conditions for three anodic coating steps. The samples were evaluated by using an ultrasonic bath filled with general purpose cleaner agent. 30 mL of PRO•PORTION™ ultrasonic cleaning agent, from Sultan Healthcare, Englewood, N.J., was mixed with about one gallon of deionized water to make ultrasonic cleaning bath. The pH of the solution pH was adjusted about 11.0±0.2 units and maintained by adding caustic as needed. Ultrasonic energy was applied for about four to six hours while maintaining the bath temperature constant by circulating the bath to an air blower. The cosmetic appearance and dye migration were measured to determine the fail and pass mode. Each of the samples was wiped with moderate pressure using a white cotton inspection glove or high quality paper wipe soaked with reagent grade Isopropyl alcohol. Failure mode was defined as a showing of any evidence of color bleeding on the glove or wipe.

TABLE 1

Result of high pH alkaline ultrasonic cleaning

| | | | STEPS INVOLVED | | | Results | |
|---|---|---|---|---|---|---|---|
| Alloy | Coating Thickness, mm | Dye | 1st Metal Solution | Thermal Synthesis | 2nd Metal Solution | Appearance | Dye Migration |
| 6061 | 0.018 | All* | Nickel Salt for 35 min | NA | Steam Seal for >30 min | Fail | Fail |
| 5052 | 0.018 | All | Nickel Salt for 35 min | NA | Steam Seal for >30 min | Fail | Fail |
| 6061 | 0.013 | Bordeaux/ Purple | Nickel Fluoride for 15 min | NA | NA | Fail | Fail |
| 6061 | 0.018 | Black | Nickel Salt for 35 min | NA | Nickel Fluoride for 10 min | Fail | Fail |
| 5052 | 0.015 | Black/Red | Nickel Salt for 30 min | NA | DI Boiling Water | Fail | Fail |
| 6061 | 0.030 | Black | NA | NA | Nickel Salt for 35 min | Fail | Fail |

*blue, dark blue, red, black, green

Example 2

This example compares the performance of a conventional anodic oxide coating and of the sealed, partially crystalline anodic oxide coating in accordance with the present invention, after exposure to high pH, alkaline conditions.

Figure 8C:
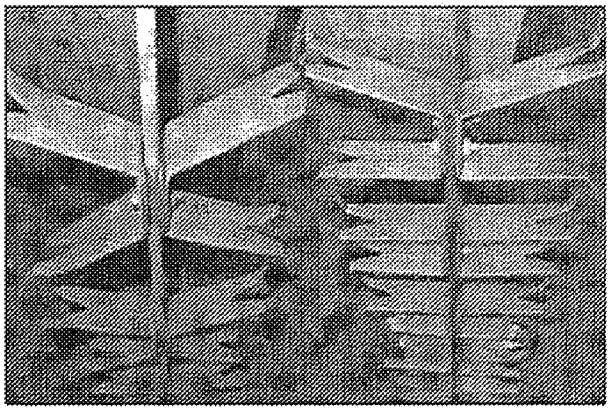
FIGS. 8B-8D are copies of photographs showing the aluminum racks having a crystalline sealed anodized coating of the present invention and racks with conventional anodic coating.
Figure 8D:
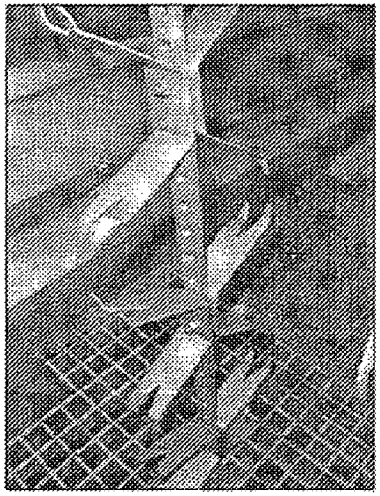
Figure 8B:
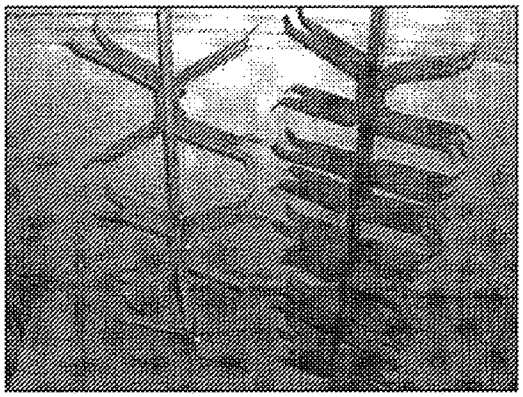
Figure 8A:
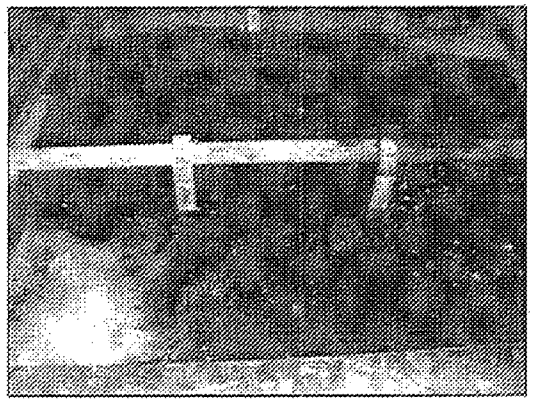
FIG. 8A is a copy of a photograph of a sodium hydroxide bath being agitated for evaluating aluminum racks having a crystalline sealed anodized coating of the present invention and the conventional anodic coating.

Two aluminum racks were prepared by hard anodizing using (1) the partially crystalline coating of the invention and (2) black dyed conventionally anodized coating according to the nickel acetate seal method. Each of the racks was placed in a hot etch solution containing about 120 g/liter of sodium hydroxide at 140° F. (about 60° C.). Each of the solutions was vigorously agitated with air as illustrated in FIG. 8A.

The surface of the conventionally prepared aluminum rack was observed to be completely stripped off after about two minutes. However, the coating on the anodized rack prepared in accordance with the present invention maintained its properties even after about 20 more minutes in the hot etch solution. FIG. 8B shows the anodized aluminum racks (left-partially crystalline sealed anodic coating of the invention, right-conventional nickel acetate seal) before immersion. FIG. 8C shows the aluminum racks after immersion for 2 minutes, the rack shown on the left, prepared to have the partially crystalline sealed anodic coating of the invention, did not show etching whereas the coating of the rack shown on the right, prepared with conventional nickel acetate seal, was removed. As shown in FIG. 8D, the rack, prepared to have the partially crystalline anodic coating of the invention, still had an acceptable coating even after immersion for 20 minutes in the alkaline bath.

Example 3

This example compares the performance of a conventional anodic oxide coating and the sealed anodic oxide coating in accordance with the present invention, after exposure to medical sterilization conditions.

Figure 9:
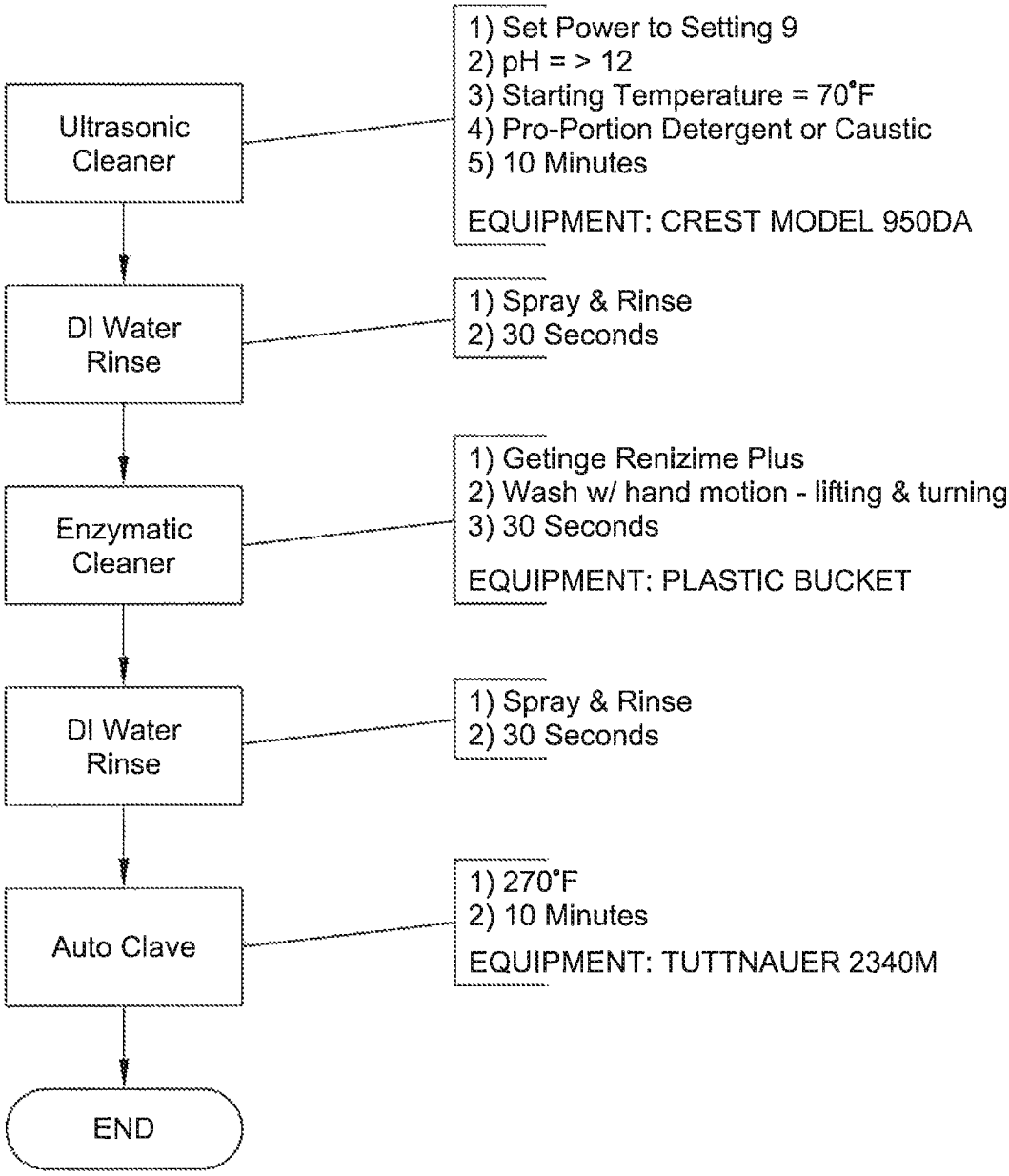
FIG. 9 a flowchart of a sterilization procedure that may be utilized to disinfect articles of the invention.

Several 4 inch×4 inch sample panels were prepared to have the sealed anodized coating of the invention along with conventional anodic oxide panel samples. The samples were evaluated by using the Accelerated Sterilization Procedure (ASP) illustrated in FIG. 9 which includes ultrasonic and autoclave operations. Sterilization involved transferring the samples into an ultrasonic system filled with general purpose cleaner solution. 30 mL of PRO•PORTION™ ultrasonic cleaning agent was mixed with about one gallon of deionized water to make ultrasonic cleaning bath. The pH of the solution was adjusted to be about 12.5±0.2 units and maintained by adding caustic. Ultrasonic energy was applied for about 45 minutes while maintaining the bath temperature constant. After ultrasonic cleaning, the samples were rinse with deionized water to remove cleaning solution. After rinsing, the samples were immersed into an enzymatic cleaning agent, RENUZME™ agent from Getinge USA, Inc., Rochester, N.Y., for about 30 seconds. The samples were then rinsed under deionized water for about 30 seconds to remove cleaning agent. After rinsing, the samples were autoclaved at about 132° C. for about 45 minutes. Each of the samples was sterilized by repeating the cycles for 4 times. Table 2 presents the results from the sterilization operations.

TABLE 2

| | | Steps Involved | | | Failure mode | |
|---|---|---|---|---|---|---|
| | | 1st Metal | | 2nd Metal | Appeared After | |
| Color | Coating Thickness, mm | Salt Solution | Thermal Synthesis | Salt Solution | Cosmetic Appearance | Dye Migration |
| Blue | 0.018 | NA | NA | Nickel Acetate: 35 min | 1st cycle | 1st cycle |
| Dark Blue | 0.015 | NA | NA | Nickel Acetate: 35 min | 1st cycle | 1st cycle |
| Bordeaux | 0.015 | NA | NA | Nickel Acetate: 35 min | 1st cycle | 1st cycle |
| Green | 0.018 | NA | NA | Nickel Acetate: 35 min | 1st cycle | 1st cycle |
| Black | 0.015 | NA | NA | Nickel Acetate: 35 min | 1st cycle | 1st cycle |
| Black | 0.018 | Nickel Fluoride: 25 min and followed by pH = 13 | NA | Nickel Acetate: 35 min | 1st cycle | 1st cycle |
| Black | 0.033 | NA | NA | Nickel Acetate: 35 min | 1st cycle | 1st cycle |
| Black | 0.051 | | NA | Nickel Acetate: 40 min | 1st cycle | 1st cycle |
| Black | 0.051 | Nickel fluoride: 25 min and followed by pH = 13 w/ surfactant | At 250° C. for 1 hr | Nickel Acetate: 35 min | Passed after 4th cycles | Passed after 4th cycles |

Example 4

This example compares the performance of a conventional anodic oxide coating and of the sealed anodized coating in accordance with the present invention, after exposure to dishwashing conditions.

Sample aluminum panels with conventional anodic oxide coatings as well as with the crystalline sealed anodic coating of the invention were prepared. The panels were placed in residential dishwashers during normal dishwashing cycles, about 60 to 90 minutes using commercially available dry detergents. Two 10 washing cycles were performed over 20 days. As presented in Table 3, which summarizes the observations and results, only the panel samples with the crystalline sealed anodic coating finish showed no signs of functional or aesthetic property loss.

TABLE 3

| Sample ID | Anodic Coating Process | Coating Thickness | Result on Cosmetic Appearance |
|---|---|---|---|
| NA HC | Undyed conventional | 0.046 mm | Failed |
| NA HC | Black dyed conventional | 0.046 mm | Failed |
| NA | Undyed SANFORD QUANTUM ® | 0.046 mm | Failed |
| NA | Black dyed SANFORD QUANTUM ® | 0.046 mm | Failed |
| SB | Undyed, crystalline sealed anodized | 0.046 mm | Passed |
| SB | Black dyed, crystalline sealed anodized | 0.053 mm | Passed |

Example 5

This example compares the performance of a conventional anodic oxide coating and the crystalline sealed anodized coating in accordance with the present invention after soaking in a solution of about 0.04% sodium hydroxide.

Two aluminum samples were prepared with the crystalline sealed anodized coating of the invention. A conventional aluminum anodic oxide sample panel was also prepared. The surface of each of the sample panels was scratched by scuffing with a metal grate. The scratched panels were soaked in a 0.04% solution of sodium hydroxide and water (pH of about 11.6 to 12.3) for about 24 hours. The panels were abraded and soaked for 3 or more cycles and the cosmetic appearance of each was evaluated after each cycle by scratching the surface using metal grate. Table 4 presents the observations after scratching.

TABLE 4

| ID | Process | Coating Thickness | Abrasion and Cosmetic Failure Mode Appearance Cycles |
|---|---|---|---|
| NA | Undyed conventional | 0.051-0.061 mm | 1st |
| SB | Undyed, crystalline sealed anodized | 0.051-0.061 mm | >3rd |
| SB | Black dyed, crystalline sealed anodized | 0.051-0.061 mm | >3rd |

Example 6

This example evaluates conventional anodic oxide coatings and the crystalline sealed anodized coating of the invention after exposure to low pH conditions, sulfuric acid immersion.

Aluminum samples were prepared with the crystalline sealed anodized coating of the invention. Three conventional anodic oxide coating samples using different seal conditions were prepared from 1 inch×1 inch 6061 aluminum alloy coupons. The coating thickness and weight of each of the samples was determined according to ASTM B 137. The samples were soaked in about 0.71 vol % aqueous sulfuric acid solution, having a pH of about 0.8 units, for about 24 hours. The coating thickness and weight were measured after immersion in the sulfuric acid solution and compared with initial values. The results and observations of the samples are presented in Table 5. The data notes that all three conventional anodic oxide coatings were completely dissociated in the aqueous sulfuric solution, i.e., the mass of the coatings were completely removed from the aluminum surface. Further, bare aluminum appeared to be attacked by the acid solution as indicated by a negative weight loss. In contrast, the crystalline sealed anodized aluminum sample of the present invention showed a coating thickness loss of about 20% and weight loss of about 31%. Furthermore, the partially crystalline sealed anodized sample of the invention appeared to maintain its hardness and integrity.

TABLE 5

| | | Coating Thickness, mm | | Coating Mass, grams | |
|---|---|---|---|---|---|
| ID | Process | Before | After | Before | After |
| Invention | crystalline sealed anodized | 0.044 | 0.036 | 0.2642 | 0.1812 |
| Convention | classic hardcoat followed by nickel acetate seal | 0.051 | 0.0 | 0.2624 | −0.4910 |
| Convention | Quantum hardcoat followed by nickel acetate seal | 0.044 | 0.0 | 0.2312 | −0.3349 |
| Convention | Quantum hardcoat followed by nickel fluoride seal | 0.043 | 0.0 | 0.2246 | −0.3658 |

Example 7

This example compares the abrasion resistance of a conventional sealed anodic oxide aluminum coating and the sealed anodized aluminum coating of the invention.

Taber abrasion among the three samples, a sealed anodized aluminum sample of the invention, a double sealed anodic oxide aluminum sample (prepared by nickel fluoride treatment followed by nickel acetate treatment), and a conventional anodic oxide aluminum coating having coating thickness of 0.05 mm (2.0 mil), were evaluated after soaking each in sodium hydroxide for 3 and 11 days at ambient temperature.

Figure 10B:
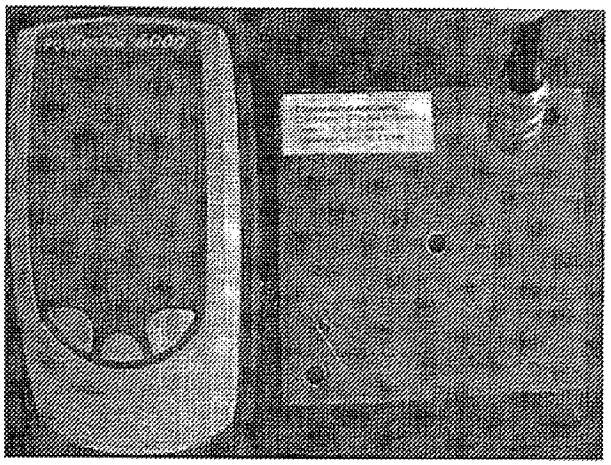
FIGS. 10A-10C are copies of photographs showing the abrasion performance of a crystalline sealed anodized coating of the invention (FIG. 10C), and of a conventional anodic oxide coating (FIG. 10B)
Figure 10C:
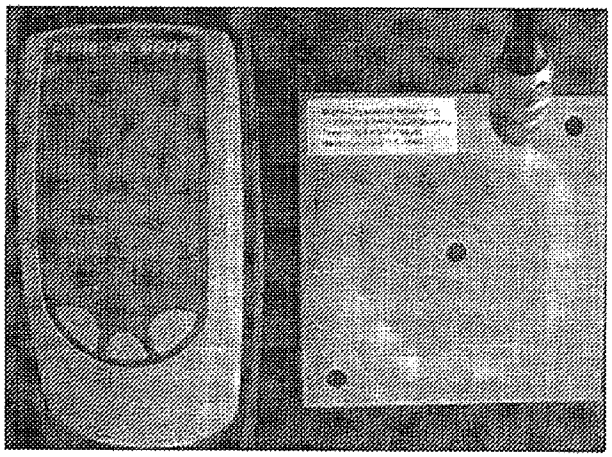
Figure 10A:
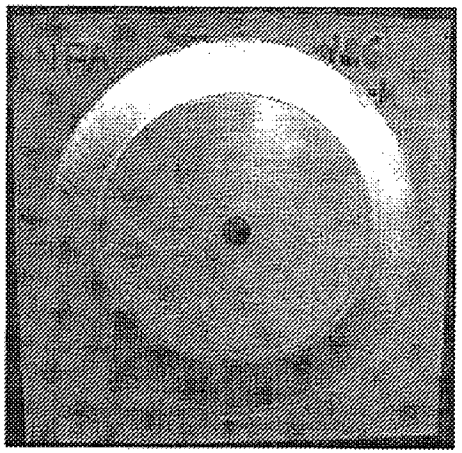

FIG. 10A is a copy of a photograph of the 3 days old double sealed anodic oxide aluminum sample after performing the Taber procedure. It indicated entire coating thickness loss, showing bare aluminum surface in the abrasion area.

The 11 days old sealed anodized aluminum sample of the invention had less coating thickness loss from about 0.05 mm (2.0 mil) to 0.038 mm (1.5 mil) after performing the Taber procedure. FIG. 10B is a copy of a photograph showing the appearance of 3 days old conventional anodic oxide coating after abrasion testing and FIG. 10C a copy of a photograph showing the appearance of the 11 days old sealed anodized aluminum sample after abrasion testing.

Example 8

This example evaluates the phase transformation of metal hydroxide product into metal oxide solids via thermal treatment during the preparation of a sealed anodized substrate of the invention.

Figure 11A:
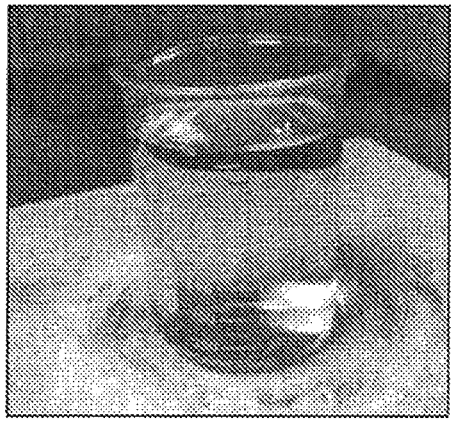
FIGS. 11A-11E are copies of photographs illustratively showing the phase transformation of a metal hydroxide product into metal oxide solids via thermal treatment relevant to the coating of the invention.
Figure 11B:
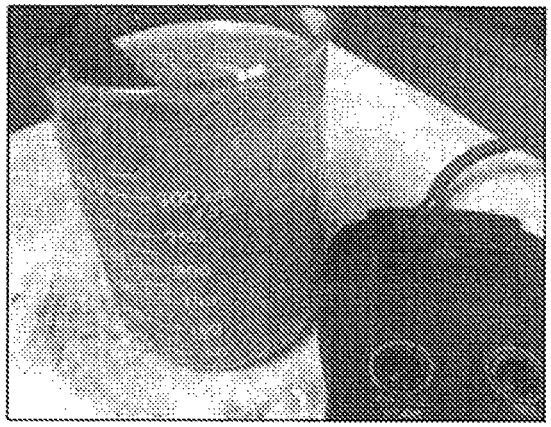
Figure 11C:
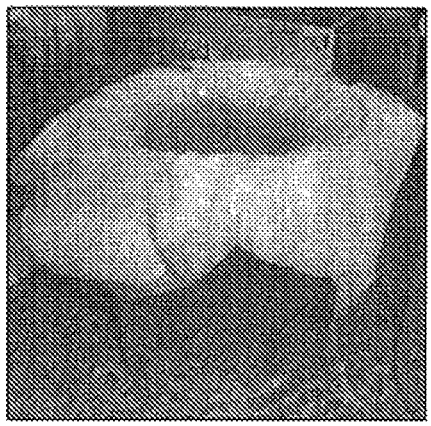
Figure 11D:
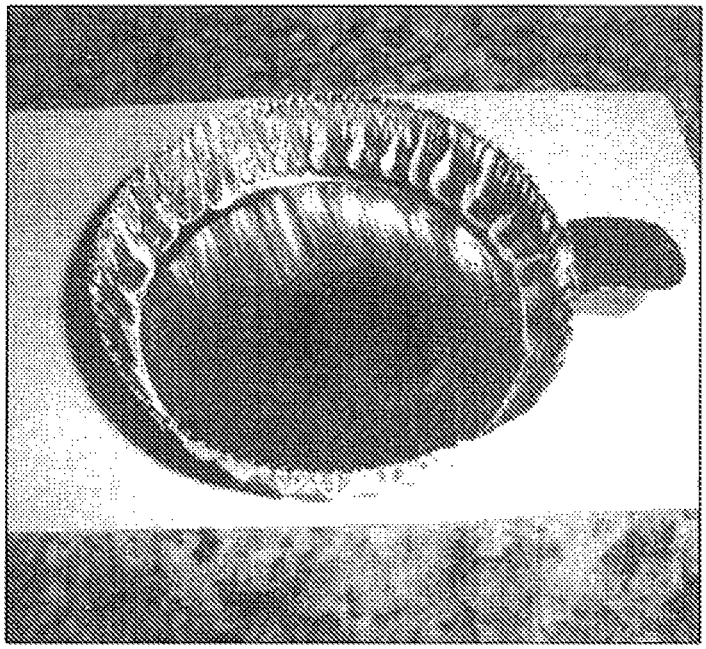

A metal salt solution including nickel acetate having about 5.0 wt % was prepared as illustrated in FIG. 11A. The pH of the solution was increased to about 10.0 units by adding aqueous sodium hydroxide, NaOH, solution. The solution became greenish turbid, which is indicative of nickel hydroxide precipitation, as illustrated in FIG. 11B. The precipitate was filtered using a No. 40 Whatman filter paper, as illustrated in FIG. 11C. The filter paper with the precipitate was dried at about 60° C. for about 1 hour. The dried green colored precipitate, nickel hydroxide, was collected in a weigh dish as illustrated in FIG. 11D and heated in an oven at about 250° C. for about 1 hour.

Figure 11E:
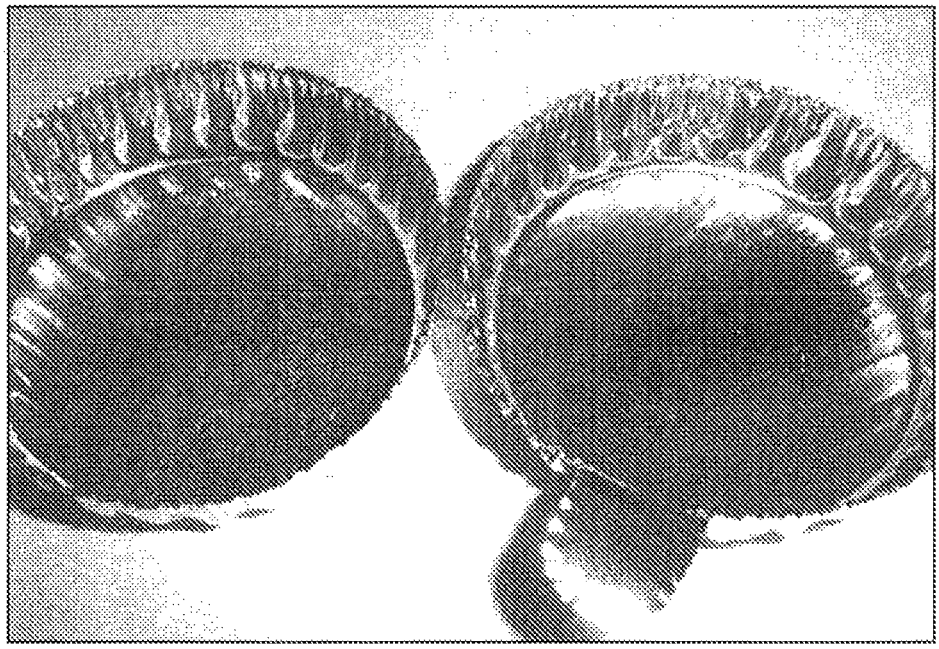

The green precipitate became black particles after the thermal treatment. The black particles are believed to be nickel oxide, $Ni_2O_3$. FIG. 11E shows the green precipitate (on the left) before thermal synthesis, showing greenish color particles, nickel hydroxide, and the thermally treated particles (on the right) which are black color particles of nickel oxide.

Having now described some illustrative embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims. Further, acts, elements, and features discussed only in connection with one embodiment are not intended to be excluded from a similar role in other embodiments.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A sealed anodized metal comprising:

a metallic substrate comprising a first metal;

an anodic region contiguous with at least a portion of the metallic substrate, the anodic region having a plurality of cells comprising an amorphous first metal oxide, each of the plurality of cells having a pore with a pore filler in at least a portion thereof, the pore filler comprising at least one of a crystalline transition metal oxide, a crystalline precious metal oxide, a metalloid oxide, an alkali earth metal oxide, and an alkali metal oxide; and a seal region adjacent to at least a portion of the anodic region, the seal region comprising at least one of a crystalline first metal oxide, a crystalline precious metal oxide, a crystalline alkali metal oxide, a crystalline first metal hydroxide, a crystalline precious metal hydroxide, and a crystalline alkali metal hydroxide.

2. The sealed anodized metal of claim 1, wherein the precious metal is one of silver, ruthenium, palladium, iridium, platinum, gold, and alloys thereof.

3. The sealed anodized metal of claim 1, wherein the first metal is aluminum or an alloy thereof.

4. The sealed anodized metal of claim 3, wherein the pore filler comprises one of crystalline nickel oxide, tin oxide, cobalt oxide, magnesium oxide, silicon oxide, and sodium oxide.

5. The sealed anodized metal of claim 3, wherein the anodic region comprises columnar cells of aluminum oxide and pore fillers of crystalline nickel hydroxide, and wherein the seal region comprises crystalline aluminum hydroxide.

6. The sealed anodized metal of claim 1, wherein the seal region comprises aluminum hydroxide that has a level of crystallinity that increases with a depth of the seal region.

7. The sealed anodized metal of claim 1, further comprising an interfacial region positioned between the anodic region and the seal region, the interfacial region comprising at least one of crystalline transition metal hydroxide, crystalline alkali metal hydroxide, and crystalline precious metal hydroxide.

* * * * *

UNITED STATES PATENT AND TRADEMARK OFFICE

CERTIFICATE OF CORRECTION

PATENT NO. : 8,512,872 B2
APPLICATION NO. : 12/947197
DATED : August 20, 2013
INVENTOR(S) : Cabot et al.

It is certified that error appears in the above-identified patent and that said Letters Patent is hereby corrected as shown below:

On the title page Item (73) delete "Dupalectpa-CHN, LLC" and insert --Duralectra-CHN, LLC--

Signed and Sealed this
Twenty-ninth Day of July, 2014

Michelle K. Lee

Michelle K. Lee
*Deputy Director of the United States Patent and Trademark Office*